US009804527B2

(12) United States Patent
Nose et al.

(10) Patent No.: US 9,804,527 B2
(45) Date of Patent: Oct. 31, 2017

(54) SEALING APPARATUS FOR DEVELOPING DEVICE

(71) Applicant: CANON KABUSHIKI KAISHA, Tokyo (JP)

(72) Inventors: Katsuya Nose, Kashiwa (JP); Fumiyoshi Saito, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/003,049

(22) Filed: Jan. 21, 2016

(65) Prior Publication Data

US 2016/0216639 A1 Jul. 28, 2016

(30) Foreign Application Priority Data

Jan. 22, 2015 (WO) ..... PCT/JP2015/051629

(51) Int. Cl.
*G03G 15/08* (2006.01)

(52) U.S. Cl.
CPC ..... *G03G 15/0886* (2013.01); *G03G 15/0884* (2013.01); *G03G 15/0893* (2013.01)

(58) Field of Classification Search
CPC ..... G03G 15/0817; G03G 15/0898; G03G 15/0882; G03G 15/0884; G03G 15/0874; G03G 15/0881; G03G 15/0886; G03G 12/1832; G03G 2221/1612; G03G 15/0893; G03G 15/0889; G03G 15/0877; G03G 2215/0822; G03G 2215/0838
USPC ..... 399/102, 103, 105, 106, 119
See application file for complete search history.

(56) References Cited

U.S. PATENT DOCUMENTS

2005/0053393 A1* 3/2005 Harada ..... G03G 15/0855 399/106
2011/0286768 A1* 11/2011 Muto ..... G03G 15/0808 399/254

FOREIGN PATENT DOCUMENTS

| | | | |
|---|---|---|---|
| JP | H0221591 | A | 1/1990 |
| JP | 2006201528 | A | 8/2006 |
| JP | 2010085970 | A | 4/2010 |
| JP | 2011100064 | A | 5/2011 |
| JP | 2011242639 | A | 12/2011 |

* cited by examiner

*Primary Examiner* — Walter L Lindsay, Jr.
*Assistant Examiner* — Jessica L Eley
(74) *Attorney, Agent, or Firm* — Canon U.S.A. Inc., IP Division

(57) ABSTRACT

In a developing device in which initial developer is sealed in and a developer discharge mechanism (a trickle mechanism, or an ACR mechanism) is provided, the driving-torque load generated in the developing device is suppressed, regardless of the state of distribution of the developer that is sealed in the developing device.
The order of releasing seals provided over openings is defined as follows. First, a seal provided on the downstream side of a stirring chamber starts to be released. Then, a seal provided over a discharge port is released. Lastly, a seal provided on the upstream side of the stirring chamber starts to be released.

25 Claims, 19 Drawing Sheets

SEALING APPARATUS FOR DEVELOPING DEVICE

TECHNICAL FIELD

The present invention relates to a developing device in which a two-component developer that is a mixture of a toner and a carrier is used for a latent image formed on an image bearing member, and an excessive portion of the developer is dischargeable while a fresh portion of the developer is supplied.

BACKGROUND ART

In a hitherto known electrophotographic image forming apparatus, a latent image formed on an image bearing member is developed with a developer contained in a developing device, whereby the latent image is visualized as a toner image. A two-component developing method employing, as the developer, a two-component developer that is a mixture of a nonmagnetic toner and a magnetic carrier, mainly, is more beneficial in the long-term stability of image quality and so forth than other developing methods that are currently proposed.

FIG. 19 is a schematic sectional view of a developing device 4 that employs the two-component developing method. The hitherto known developing device employing the two-component developing method contains a two-component developer as the developer in a development container 40. To convey and stir the two-component developer in the development container, a proposal of using a plurality of developer conveying members is implemented. Referring to FIG. 19, the development container 40 includes a development chamber in which a developing sleeve 41 as a developer bearing member and a first stirring screw 44 are provided, and the developer is supplied to the developing sleeve 41. The development container 40 further includes a stirring chamber in which a second stirring screw 45 is provided. Furthermore, a partition 46 is provided between the development chamber and the stirring chamber in such a manner as to separate the two from each other. The partition 46 has, at longitudinal-direction ends thereof, delivery openings, respectively, through which the developer is delivered between the development chamber and the stirring chamber. Thus, the two-component developer circulates through the development container 40 with the aid of the first stirring screw and the second stirring screw. Furthermore, the developing sleeve 41 provided in the development chamber includes a magnet roll 42 thereinside. Thus, a magnetic brush of the two-component developer is formed on the developing sleeve 41. With the rotation of the developing sleeve 41, the magnetic brush of the two-component developer is conveyed to a position facing a photosensitive drum 1. Thus, the magnetic brush is brought near or into contact with the photosensitive drum 1. Then, when a development bias is applied to the developing sleeve 41, an electrostatic latent image formed on the photosensitive drum 1 is developed with the toner. Thus, a toner image corresponding to the electrostatic latent image is formed on the photosensitive drum 1.

As described above, in the developing device 4 that uses the two-component developer, the toner and the carrier of the two-component developer contained in the developing device 4 are stirred and are charged by friction. Subsequently, the charged toner is supplied to the photoconductor drum 1 by the developing sleeve 41. Thus, the latent image on the photoconductor drum 1 is developed. In this process, while the toner is consumed and supplied, the carrier is neither consumed nor supplied but remains in the developing device 4. Therefore, the carrier is stirred in the developing device 4 more frequently than the toner. Such a situation tends to lead to a deterioration in the charging ability due to accumulation of external additives, adhesion of wax, toner spent, and so forth. Consequently, the amount of developer conveyed is reduced, the amount of charge generated by physical friction of particles of the developer becomes insufficient, and the resulting image may have defects such as nonuniformity in density or fog in a white background.

Accordingly, in the related art, such deterioration of the carrier is suppressed by supplying not only the toner but also the carrier, according to need, into the developing device 4 from a developer supply port 49. Meanwhile, an excessive portion of the two-component developer that gradually builds up in the developing device 4 with the supply of the carrier is collected from a developer discharge port. Thus, while the toner whose amount is reduced with the consumption thereof is supplied, the deteriorated portion of the carrier in the developing device 4 is replaced with a fresh refill of the carrier. Such a developing method is proposed by PTL 1.

In the above developing method, the two-component developer containing the carrier is supplied while being discharged. Therefore, the deterioration of the carrier is suppressed, and the development characteristics exhibited by the two-component developer in the developer container are kept constant. Consequently, the deterioration in the image quality due to changes in the development characteristics of the developer can be suppressed over a long time.

Regarding an image forming apparatus or an exchangeable developing device or process cartridge, shipping techniques in which an initial portion of the developer that is to be used initially is sealed in the developing device so as to be isolated from outside air are proposed by PTL 2 and PTL 3. This is because of the following reason. If the developer is left exposed to outside air having a high temperature and a high humidity, the developer absorbs the moisture and is deteriorated. Consequently, the developer becomes unable to exhibit desired performance at the time of initial startup. The above techniques also produce an effect of preventing the developer from leaking from the developing device or the process cartridge during transportation after the shipment. The technique according to PTL 2 includes a proposal in which a sealing member that seals in the developer is released by a user or a serviceman. The technique according to PTL 3 includes a proposal in which, when the developing device is attached to an image-forming-apparatus body and is activated, a sealing member is wound up and is thus released.

CITATION LIST

Patent Literature

PTL 1: Japanese Patent Publication No. 2-21591
PTL 2: Japanese Patent Laid-Open No. 2006-201528
PTL 3: Japanese Patent Laid-Open No. 2011-242639

However, when the configuration proposed by PTL 2 or PTL 3 in which the initial developer was sealed in the developing device was applied to the developing device or the process cartridge disclosed by PTL 1 that had the discharge port for discharging the developer, the following hindrance occurred.

At the time of initialization of the developing device or the process cartridge, a load torque that occurred at the releasing of the sealing member that sealed in the developer caused cracking of gears/chipping of gear teeth or damage to the stirring screw in some cases. This hindrance tended to be pronounced particularly when the initial developer in the developing device or the process cartridge was distributed unevenly in the development container as a result of transportation or the like.

The present invention is based on the above background, an aspect of the present invention is to provide a developing device including a sealing member that seals an initial portion of a developer in a developing device and in which the load torque generated at the releasing of the sealing member is small even if the distribution of the developer in a development container at the releasing of the sealing member is uneven.

SUMMARY OF INVENTION

The above aspect is achieved by the following developing device according to the present invention. Specifically, a developing device includes: a first chamber that contains developer in an initial state; a second chamber that provides, in combination with the first chamber, a path of circulation of the developer; a partition that separates the first chamber and the second chamber from each other; a first conveying member that conveys the developer in the first chamber; a second conveying member that conveys the developer in the second chamber; a first communication port provided on a downstream side in a direction of conveyance in the first chamber and that delivers the developer from the first chamber to the second chamber; a second communication port provided on an upstream side in the direction of conveyance in the first chamber and that delivers the developer from the second chamber to the first chamber; a first sealing portion bonded to a periphery of the first communication port and that releasably seals the first communication port; a second sealing portion bonded to a periphery of the second communication port and that releasably seals the second communication port; a supply port from which the developer is supplied, the developer being a mixture of a magnetic carrier and a nonmagnetic toner; a discharge port from which an excessive portion of the developer is dischargeable; a third sealing portion bonded to a periphery of the discharge port and that releasably seals the discharge port; and a winding shaft to which the first sealing portion, the second sealing portion, and the third sealing portion are attached and that is capable of winding up the sealing portions when receiving a driving force, wherein a total bonded area of each of the sealing portions in a width direction that is orthogonal to a direction of releasing of the sealing portion varies in the direction of releasing of the sealing portion, wherein positions of the respective sealing portions at each of which the bonded area in the width direction is largest start to be released at different timings, and wherein the first communication port, the discharge port, and the second communication port start to be opened in that order.

Further features of the present invention will become apparent from the following description of exemplary embodiments with reference to the attached drawings.

DESCRIPTION OF EMBODIMENTS

First Embodiment

An image forming apparatus according to a first embodiment of the present invention will now be described in detail with reference to the drawings. The first embodiment concerns an exemplary full-color, two-component-developer image forming apparatus of a so-called tandem type in which photosensitive drums for different colors are arranged side by side. Nevertheless, the present invention only needs to have features of a developing device according to the following embodiment. For example, the present invention may be a structure that transfers an image formed on a photosensitive drum to an intermediate transfer member and further transfers the image transferred to the intermediate transfer member to a recording material (an intermediate transfer method). Alternatively, the present invention may be a structure that directly transfers an image formed on a photosensitive drum to a recording material. Alternatively, the present invention may be an image forming apparatus including one photosensitive drum. Moreover, the present invention can be embodied regardless of whether it is of a full-color or monochrome type.

Figure 1:
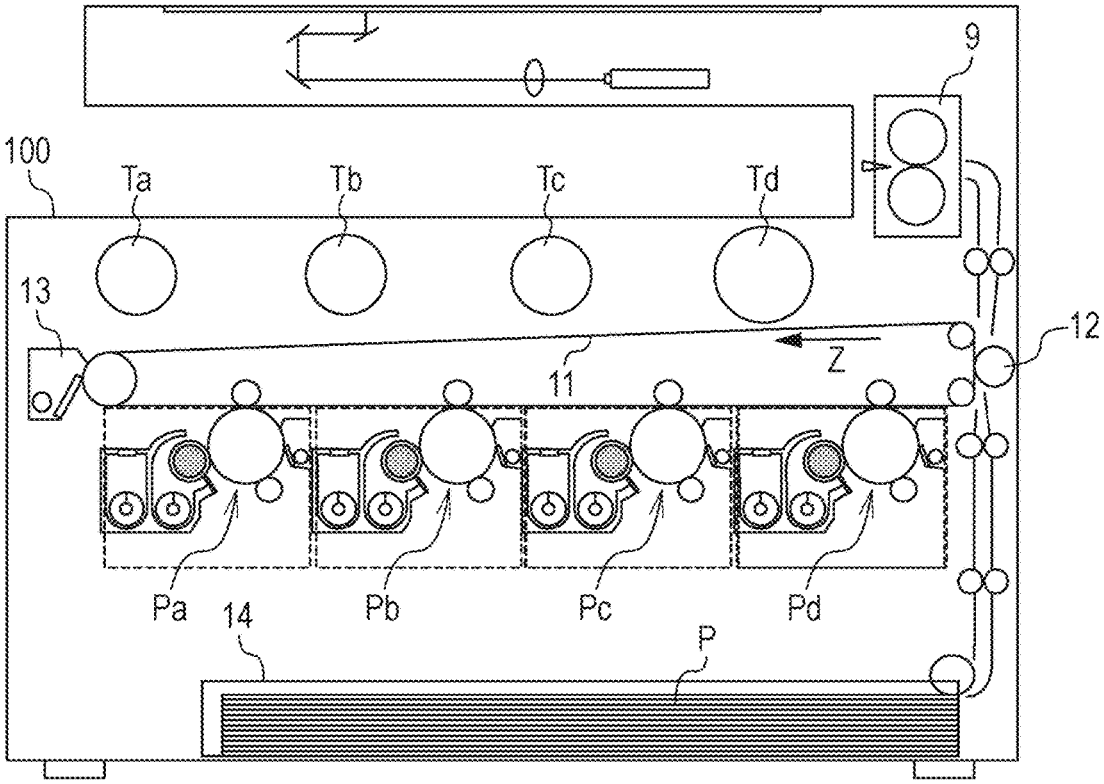
FIG. 1 is a sectional view of an image forming apparatus according to a first embodiment of the present invention.

<Outline of Image Forming Apparatus According to First Embodiment> See FIG. 1

Figure 2:
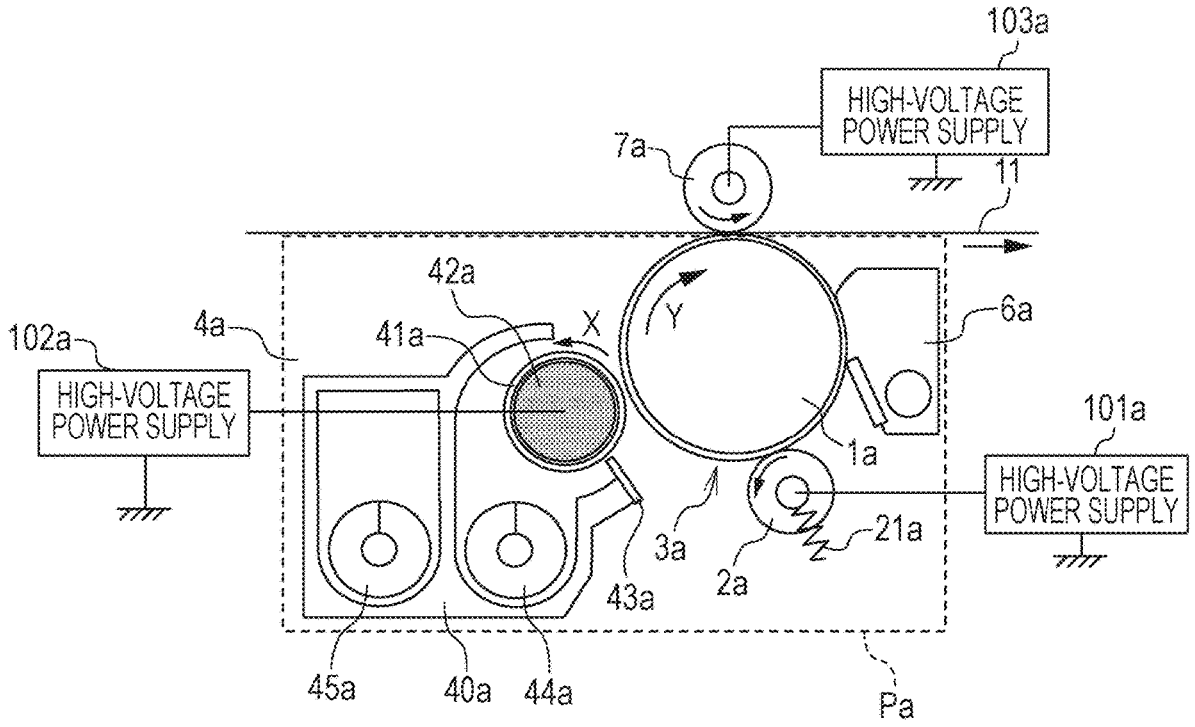
FIG. 2 is a schematic diagram of an image forming station included in the image forming apparatus illustrated in FIG. 1.

FIG. 1 is a sectional view of an exemplary tandem, intermediate-transfer, color image forming apparatus according to the present invention. The image forming apparatus according to the first embodiment is an electrophotographic color copier employing a contact-charging method and a two-component developing method. FIG. 2 illustrates a process cartridge Pa, which is one of process cartridges that form images, respectively, and peripheral elements. Since the process cartridges Pa, Pb, Pc, and Pd all have the same configuration, detailed description thereof is omitted.

As illustrated in FIGS. 1 and 2, an image forming apparatus 100 according to the first embodiment includes four image-forming process cartridges Pa, Pb, Pc, and Pd that are arranged in series in a direction of image conveyance. The process cartridges are attachable to and detachable from an image-forming-apparatus body. The process cartridges Pa, Pb, Pc, and Pd include respective photosensitive drums 1*a*, 1*b*, 1*c*, and 1*d* as image bearing members; respective charging devices 2*a*, 2*b*, 2*c*, and 2*d*; respective developing devices 4*a*, 4*b*, 4*c*, and 4*d*; and respective cleaning devices 6*a*, 6*b*, 6*c*, and 6*d*. The image-forming-apparatus body is provided with exposure devices 3*a*, 3*b*, 3*c*, and 3*d*; and primary transfer devices 7*a*, 7*b*, 7*c*, and 7*d*. Furthermore, an intermediate transfer belt 11 as an intermediate transfer member runs between the group of the photosensitive drums 1*a*, 1*b*, 1*c*, and 1*d* of the process cartridges Pa, Pb, Pc, and Pd and the group of the primary transfer devices 7*a*, 7*b*, 7*c*, and 7*d* in such a manner as to be rotatable in a direction of an arrow Z.

The exposure devices 3*a*, 3*b*, 3*c*, and 3*d* each include a light source device and a polygon mirror that are provided in a lower part of the image forming apparatus but are not illustrated. Laser light emitted from the light source device is scanningly moved with the rotation of the polygon mirror. The scanning beam of light is deflected by a plurality of reflecting mirrors. Subsequently, the deflected beam of light is focused, i.e., exposure is performed, on the generating line of a corresponding one of the photosensitive drums 1*a*, 1*b*, 1*c*, and 1*d* by an fθ lens. Thus, an electrostatic latent image corresponding to an image signal is formed on the corresponding one of the photosensitive drums 1*a*, 1*b*, 1*c*, and 1*d*.

The developing devices 4*a*, 4*b*, 4*c*, and 4*d* are each filled with a predetermined amount of two-component developer in which a nonmagnetic toner having a corresponding one of colors of yellow, magenta, cyan, and black and a magnetic carrier are mixed at a predetermined mixing ratio. The developing devices 4*a*, 4*b*, 4*c*, and 4*d* sequentially form toner images by developing the latent images on the photosensitive drums with the toners having the respective colors. The toner images obtained through the development undergo primary transfer to the intermediate transfer belt 11. Furthermore, a transfer material P stored in a transfer-material cassette 14 is conveyed to a secondary transfer device 12. The toner images on the intermediate transfer belt 11 undergo secondary transfer to the transfer material P. The toner images are then fixed with heat and pressure by a fixing unit 9. Subsequently, the transfer material P having the thus obtained recorded image is discharged to the outside of the apparatus.

An intermediate-transfer-belt-cleaning blade 13 for cleaning fog toner particles, post-secondary-transfer toner particles, and the like off the surface of the intermediate transfer belt 11 is provided constantly in contact with a position of the intermediate transfer belt 11 that is on the downstream side with respect to the position of secondary transfer to the transfer material P in the direction of rotation of the intermediate transfer belt. Meanwhile, post-primary-transfer toner particles and the like remaining on the photosensitive drums 1*a*, 1*b*, 1*c*, and 1*d* are collected by the respective cleaning devices 6*a*, 6*b*, 6*c*, and 6*d*.

<Outline of Image Forming Station of Image Forming Apparatus> See FIG. 2

As illustrated in FIG. 2, the charging roller 2*a* is rotatably held by bearing members (not illustrated) provided at two respective ends of a metal core thereof. The charging roller 2*a* is urged toward the photosensitive drum 1*a* by a pressing spring 21*a*, thereby being pressed against the surface of the photosensitive drum 1*a* with a predetermined pressing force. Hence, the charging roller 2*a* rotates by following the rotation of the photosensitive drum 1*a*. A charging bias voltage under predetermined conditions is applied to the metal core of the charging roller 2*a* by a high-voltage power supply 101*a*. Thus, the surface of the rotating photosensitive drum 1*a* is charged by contact charging to a predetermined polarity and a predetermined potential. In the first embodiment, the charging bias voltage applied to the charging roller 2*a* is an oscillation voltage in which a direct-current voltage and an alternating-current voltage are superimposed on each other. More specifically, the charging bias voltage is an oscillation voltage in which a direct-current voltage of −500 V and an alternating-current voltage in the form of a sinusoidal wave that is at a frequency of 0.92 kHz and whose peak-to-peak voltage Vpp is 1.5 kV are superimposed on each other. With this charging bias voltage, the surface of the photosensitive drum 1*a* is uniformly charged to −500 V (a dark potential Vd), which is equal to the direct-current voltage applied to the charging roller 2*a*.

The developing device 4*a* includes a development container 40*a*. The development container 40*a* contains a two-component developer (a developer) mainly composed of a nonmagnetic toner (a toner) and a magnetic carrier (a carrier). The development container 40*a* has an opening in a portion thereof that faces the photosensitive drum 1*a*. A developing sleeve 41*a* as a developer bearing member is rotatably provided in the opening, with a portion of the developing sleeve 41*a* exposed to the outside.

The developing sleeve 41*a* is made of a nonmagnetic material. The surface of the developing sleeve 41*a* is roughened so as to be able to bear and convey the developer. The developing sleeve 41*a* includes thereinside a fixed magnet 42*a* as magnetic-field-generating means. In the developing operation, the developing sleeve 41*a* rotates in a direction of an arrow X (the counterclockwise direction) illustrated in FIG. 2, and the photosensitive drum 1*a* rotates in a direction of an arrow Y (the clockwise direction). The rotating developing sleeve 41*a* bears and conveys the two-component developer. The developer is provided in the form of a thin layer on the developing sleeve by a regulating member 43*a*. That is, carrier particles to the surfaces of which toner particles charged by friction are attracted are borne and conveyed by the developing sleeve 41*a* with the aid of a magnetic field generated by the magnet 42*a*. The development container 40*a* is further provided thereinside with a first stirring screw 44*a* provided opposite the developing sleeve 41*a*, and a second stirring screw 45*a* provided opposite the first stirring screw. The first stirring screw 44*a* and the second stirring screw 45*a* are provided as developer-stirring-and-conveying members. The two-component developer in the development container 40*a* is conveyed so as to circulate in the development container 40*a* while being stirred by the first and second stirring screws 44*a* and 45*a*.

A predetermined development bias is applied to the developing sleeve 41*a* by a high-voltage power supply 102*a*. In the first embodiment, the development bias voltage is an oscillation voltage in which a direct-current voltage and an alternating-current voltage are superimposed on each other. More specifically, the development bias voltage is an oscillation voltage in which a direct-current voltage of −350 V and an alternating-current voltage in the form of a rectangular wave that is at a frequency of 8.0 kHz and whose peak-to-peak voltage Vpp is 1.8 kV are superimposed on each other. With the development bias and the electric field of the electrostatic latent image formed on the surface of the photosensitive drum 1*a*, the electrostatic latent image is reversely developed.

A transfer bias voltage under predetermined conditions is applied to the primary transfer device 7*a* by a high-voltage power supply 103*a*. In the first embodiment, the primary-transfer bias voltage is a direct-current voltage. More specifically, the primary-transfer bias voltage is a direct-current voltage of +800 V. With the primary-transfer voltage, the toner image formed on the photosensitive drum 1*a* undergoes primary transfer to the intermediate transfer belt 11.

<Outline of Developer Contained in Developing Device According to First Embodiment>

Now, the two-component developer composed of the toner and the carrier and that is contained in the developing device 4*a* according to the first embodiment will be described in detail.

The toner is composed of pre-colored resin particles to which binder resin, a colorant, and any other additives, if necessary, are added; and pre-colored particles to which an external additive such as colloidal-silica fine powder is externally added. The toner is a negatively chargeable polyester-based resin and preferably has a volume-mean particle size of 4 μm or larger and 10 μm or smaller, or more preferably 8 μm or smaller. The mean particle size of the nonmagnetic toner according to the first embodiment was set to about 6.0 μm, considering the image quality and the ease of handling. For better fixability, many of recent-year toners have low melting points or low glass-transition points Tg (for example, Tg≤70° C.). Furthermore, for better releasability after fixing, some toners contain wax.

The developer according to the first embodiment is a wax-containing pulverized toner.

Preferable examples of the carrier are metals such as iron, nickel, cobalt, manganese, chromium, and rare earth each containing particles having oxidized or unoxidized surfaces; an alloy of any of the foregoing metals; oxide ferrite; and the like. The method of manufacturing such magnetic particles is not specifically limited. The carrier has a weight-mean particle size of 20 to 60 μm or preferably 30 to 50 μm, and a resistivity of 10^7 Ωcm or higher or preferably 10^8 Ωcm or higher. In the first embodiment, a carrier having a resistivity of 10^8 Ωcm was used.

Regarding the toner used in the first embodiment, the volume-mean particle size was measured by the following instrument and method. The measuring instrument used was a sheath-flow electric-resistance particle-size-distribution-measuring instrument SD-2000 (manufactured by Sysmex Corporation). The measurement method was as follows. Specifically, 0.1 ml of a surface-active agent as a dispersant, preferably, alkylbenzene sulfonate, was added to 100 to 150 ml of 1% NaCl electrolytic aqueous solution prepared by using primary sodium chloride, and 0.5 to 50 mg of a measurement sample was added thereto. The electrolytic aqueous solution in which the sample had been suspended was dispersed for about 1 to 3 minutes by using an ultrasonic dispersion device. Then, the volume-mean distribution was measured by using the above sheath-flow electric-resistance particle-size-distribution-measuring instrument SD-2000. As a condition for the measurement, the particle-size distribution of particles whose size was 2 to 40 μm was measured by using an aperture of 100 μm, whereby the volume-mean distribution was obtained. On the basis of the thus obtained volume-mean distribution, the volume-mean particle size was obtained.

The resistivity of the carrier used in the first embodiment was measured as follows. A sandwich-type cell having a measurement-electrode area of 4 cm and a distance between electrodes of 0.4 cm was used. A voltage E (V/cm) was applied between the two electrodes while a pressure corresponding to a weight of 1 kg was applied to one of the electrodes. On the basis of the current that flowed through the circuit, the resistivity of the carrier was obtained.

In the first embodiment, the development container 40 contains 240 g of two-component developer in which the toner and the carrier described above are mixed at a weight ratio of about 8:92, so that the toner concentration (the proportion (ratio) of the weight of the toner with respect to the total weight of the developer: the TD ratio) becomes 8%. Toner bottles Ta, Tb, Tc, and Td each contain refill developer in which the toner and the carrier are mixed at a weight ratio of about 90:10, so that the toner concentration (the proportion (ratio) of the weight of the toner with respect to the total weight of the developer: the TD ratio) becomes 90%.

Figure 3:
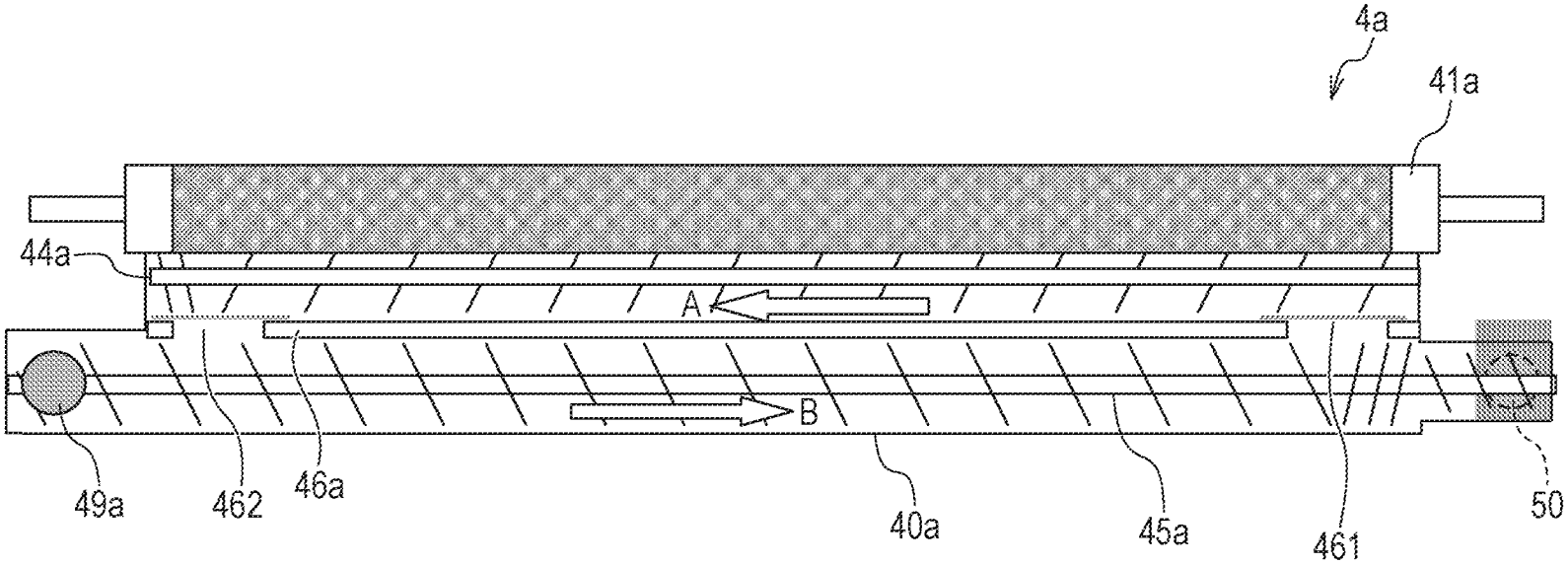
FIG. 3 is a schematic diagram of a developing device that is seen from the upper side of the image forming apparatus illustrated in FIG. 1.

<Outline of Developer Circulation in Developing Device According to First Embodiment> See FIG. 3

FIG. 3 is a schematic diagram of the developing device 4*a* that is seen from the upper side of the image forming apparatus 100. As illustrated in FIGS. 2 and 3, the development container 40*a* is provided with the developing sleeve 41*a* as a developer bearing member. Furthermore, the development container 40*a* includes a development chamber and a stirring chamber. The development chamber has the opening from which a portion of the developing sleeve 41*a* is exposed to the outside. The developer is supplied from the development chamber to the developing sleeve 41*a*. The stirring chamber communicates with the development chamber at two ends thereof and provides, in combination with the development chamber, a circulation path along which the developer circulates. The development chamber is provided with the first stirring screw 44*a* as a first conveying member. The stirring chamber is provided with the second stirring screw 45*a* as a second conveying member. Furthermore, the development container 40*a* includes a partition 46*a* that separates the development chamber and the stirring chamber from each other. Furthermore, a first opening 461 as a first communication port and a second opening 462 as a second communication port are provided at two respective ends of the development container 40*a* in the longitudinal direction of the stirring screws 44*a* and 45*a*. The first opening 461 is positioned on the downstream side in the direction of conveyance in the stirring chamber. The second opening 462 is positioned on the upstream side in the direction of conveyance in the stirring chamber. The direction of conveyance in the stirring chamber refers to the direction of conveyance by the stirring screw 45*a* (a fin 451 in the form of a helical blade illustrated in FIG. 4). The helical blade member of the first stirring screw 44*a* and the helical blade member (screw portion) of the second stirring screw 45*a* stir and convey the contained two-component developer in a direction of an arrow A in the development chamber and in a direction of an arrow B in the stirring chamber. The two-component developer is delivered from the stirring chamber to the development chamber through the first opening 461 and from the development chamber to the stirring chamber through the second opening 462, whereby the developer is conveyed in such a manner as to circulate. Furthermore, to receive a supply of fresh toner and carrier particles, the development container 40*a* has a supply port 49*a* provided at the top thereof and on the upstream side in the direction B of developer conveyance by the second stirring screw 45*a*.

Figure 4:
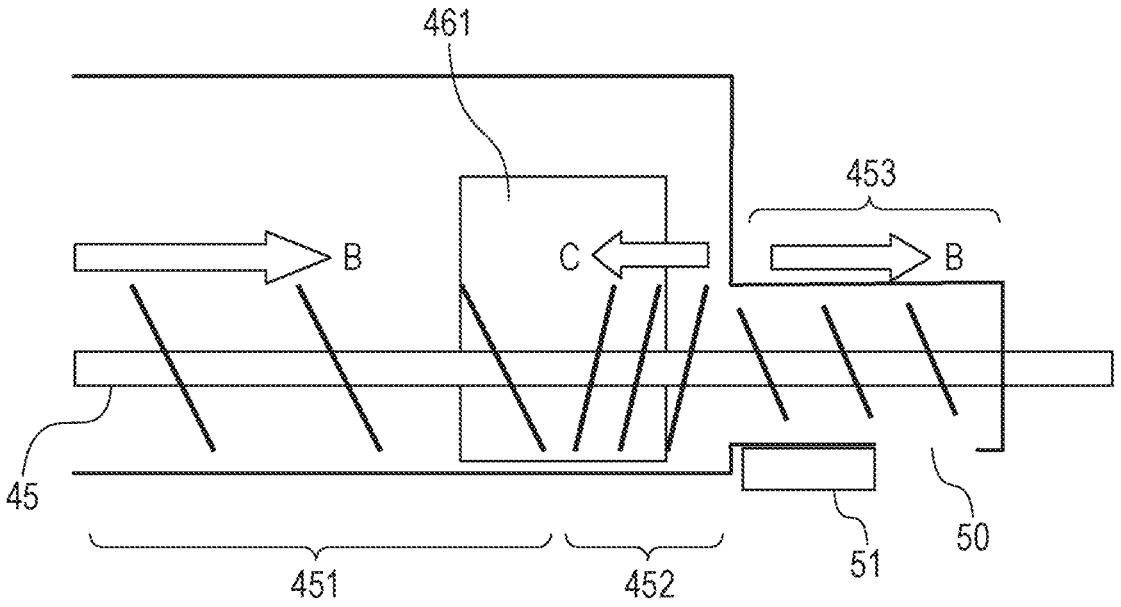
FIG. 4 is a diagram illustrating a developer discharge mechanism included in the developing device according to the first embodiment.

<Outline of Configuration Around Discharge Port of Developing Device According to First Embodiment> See FIG. 4

Referring to FIG. 4, a developer discharge mechanism included in the above developing device 4 will now be described. FIG. 4 is a schematic sectional view of a configuration around a discharge port provided in the developing device 4 that is seen from the side of the stirring chamber. The developer discharge mechanism (ACR: Auto Carrier Refresh) is provided at an extreme end on the downstream side of the stirring chamber that is provided with the second stirring screw 45*a*. The second stirring screw 45 as a developer conveying member provided in the stirring chamber includes the fin 451 as a first screw portion. The fin 451 has a helical blade-like shape and conveys the developer in the direction of conveyance B. The second stirring screw 45 further includes a reverse screw 452 on the downstream side with respect to the fin 451 in the direction of conveyance B. The reverse screw 452 rotates together with the fin 451. The reverse screw 452 includes a fin whose direction of the helix is opposite to that of the blade forming the fin 451. Hence, the reverse screw 452 generates a force that conveys the developer in a direction opposite to the direction of conveyance B. The reverse screw 452 has a fin pitch that is narrower than the standard fin pitch. Thus, the reverse screw 452 generates a conveying force acting in the opposite direction C, allows the developer conveyed thereto in the direction B to pass through the first opening 461, and delivers the developer toward the development chamber.

In the developing device configured as described above, when the image forming operation progresses and the refill developer containing the carrier is supplied to the developing device, the amount of developer in the development container 40 tends to gradually increase because only the toner is consumed in the image forming operation. Accordingly, the surface level of the developer in the development container 40 rises with the increase in the amount of developer. If the surface level of the developer goes over a certain point, the conveying ability of the reverse screw 452 is disabled. In such an event, the developer flows over the reverse screw 452. The developer discharge mechanism is provided on the downstream side of the reverse screw 452 and includes a small-size discharge screw 453 as a third screw portion that is capable of conveying the developer in the direction of conveyance B. The discharge screw 453 includes a helical blade whose direction of the helix is the same as that of the blade forming the fin 451 having the helical blade-like shape. The small-size discharge screw 453 conveys the developer to a developer discharge port 50 and drops the developer into a waste toner container that is not illustrated. Thus, the used carrier particles are replaced with initial carrier particles. The developer discharge port 50 is provided with a discharge port shutter 51 with which the developer discharge port 50 is openable and closable. When the developing device 4 is detached from the image-forming-apparatus body 100, the developer discharge port 50 is closed by the discharge port shutter 51, whereby the developer is prevented from leaking from the developing device 4.

Figure 5:
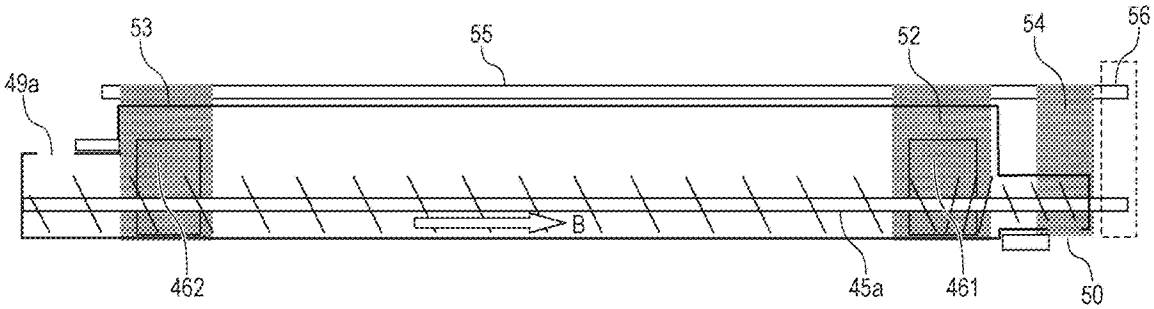
FIG. 5 is a schematic diagram of the developing device according to the first embodiment that is seen from the side of a stirring chamber.
Figure 6:
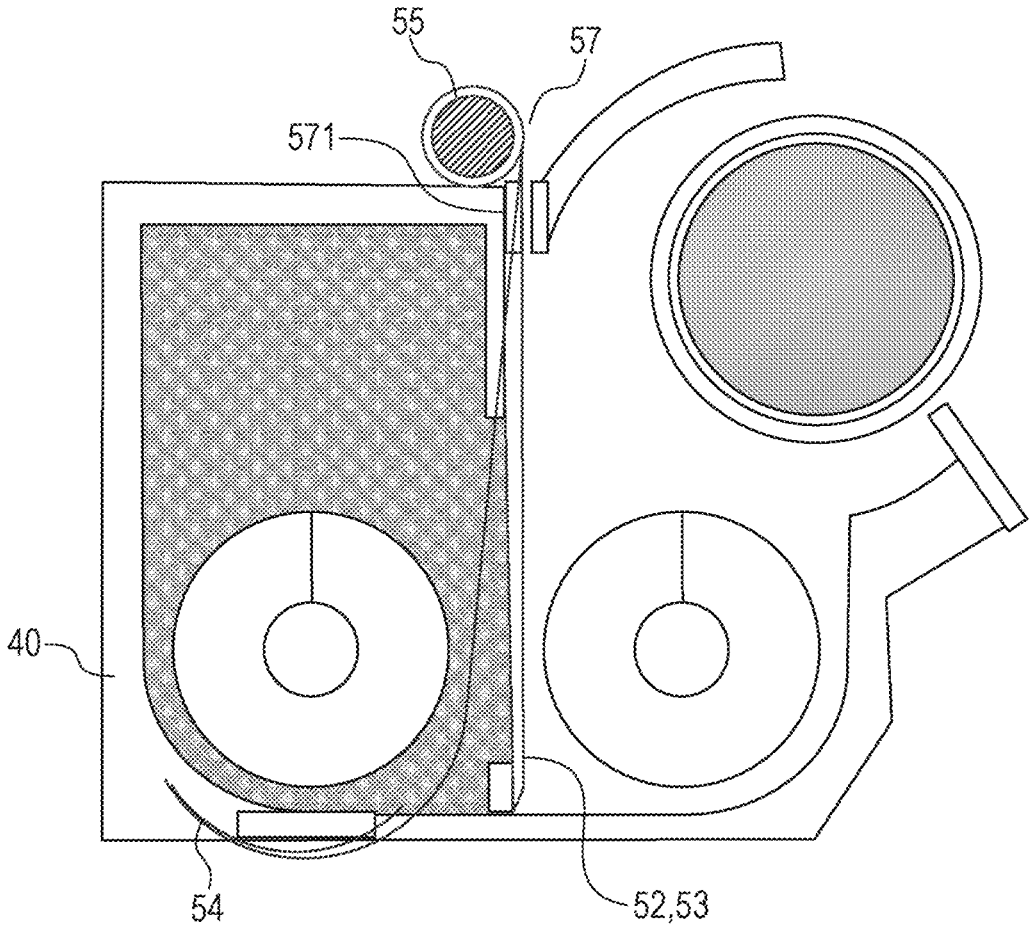
FIG. 6 is a sectional view of a sealing mechanism included in the developing device according to the first embodiment.

<Outline of Configuration for Sealing Initial Developer in Developing Device According to First Embodiment> See FIGS. 5 and 6

A configuration that seals in the initial developer according to the first embodiment will now be described with reference to FIGS. 5 and 6. FIG. 5 is a schematic diagram of the developing device 4 that is seen from the side of the stirring chamber. FIG. 6 is a sectional view of the developing device 4. In the developing device 4 according to the first embodiment that is in the initial state (a state before initialization to be described below is executed), the stirring chamber is filled with the initial developer as illustrated in FIG. 6. Furthermore, to prevent the initial developer from leaking to the outside of the developing device, seals 52 and 53 as sealing portions are provided. The seals 52 and 53 releasably seal the first opening 461 and the second opening 462, respectively, where the stirring chamber and the development chamber communicate with each other. Furthermore, to prevent the initial developer from leaking from the developer discharge port 50, a discharge port seal 54 is provided. The seals 52 and 53 each extend through a slit 57 provided in the upper lid of the developing device 4 so that the seals 52 and 53 are releasable even if a drum unit including the photoconductor drum 1 and the developing device 4 have already been positioned with respect to each other. Furthermore, to prevent the developer from leaking from the slit 57, elastic urethane members 571 are provided on both sides, respectively, of the slit 57 in such a manner as to hold the seal 52 or 53 therebetween. The seals 52, 53, and 54 are pasted to a winding shaft 55. The winding shaft 55 is connected to a gear train 56 included in the developing device 4. When a driving force is input to the developing device 4, the winding shaft 55 rotates, whereby the seals are wound up and are released.

As illustrated in FIG. 6, the seal 52 is pasted to the winding shaft 55 at one end thereof, from which the seal 52 extends to the lower end while sealing the first opening 461, and is then folded upward. In this state, the seal 52 is thermally welded to the partition 46. Likewise, the seal 53 is pasted to the winding shaft 55 at one end thereof, from which the seal 53 extends to the lower end while sealing the second opening 462, and is then folded upward. In this state, the seal 53 is thermally welded to the partition 46. The seal 54 is pasted to the winding shaft 55 at one end thereof, and is folded while sealing the developer discharge port 54. In this state, the seal 54 is thermally welded to the development container 40. The seals are each welded in the folded state so that the driving torque to be applied to the winding shaft at the time of wining of the seals is reduced. The first embodiment employs a shipping method in which the developing device 4, which is filled with the initial developer, is packed with the image-forming-apparatus body. Sealing in the initial developer by using the seals 52, 53, and 54 as in the first embodiment can reduce the probability that the developer may leak from the developing device 4 during transportation even if the developing device 4 is packed with the image-forming-apparatus body. Furthermore, the probability that the initial developer may be discharged from the developer discharge port 50 can be reduced. In the first embodiment, the supply port 49*a* is provided in the stirring chamber but is connected to a supply path provided in the apparatus body at the time of packing. Hence, there is no chance that the initial developer may leak from the supply port 49*a*. Therefore, the supply port 49*a* is not sealed with a seal. In the first embodiment, a supply port shutter that closes the supply port 49*a* when the developing device 4 is removed from the apparatus body is provided.

Figure 7:
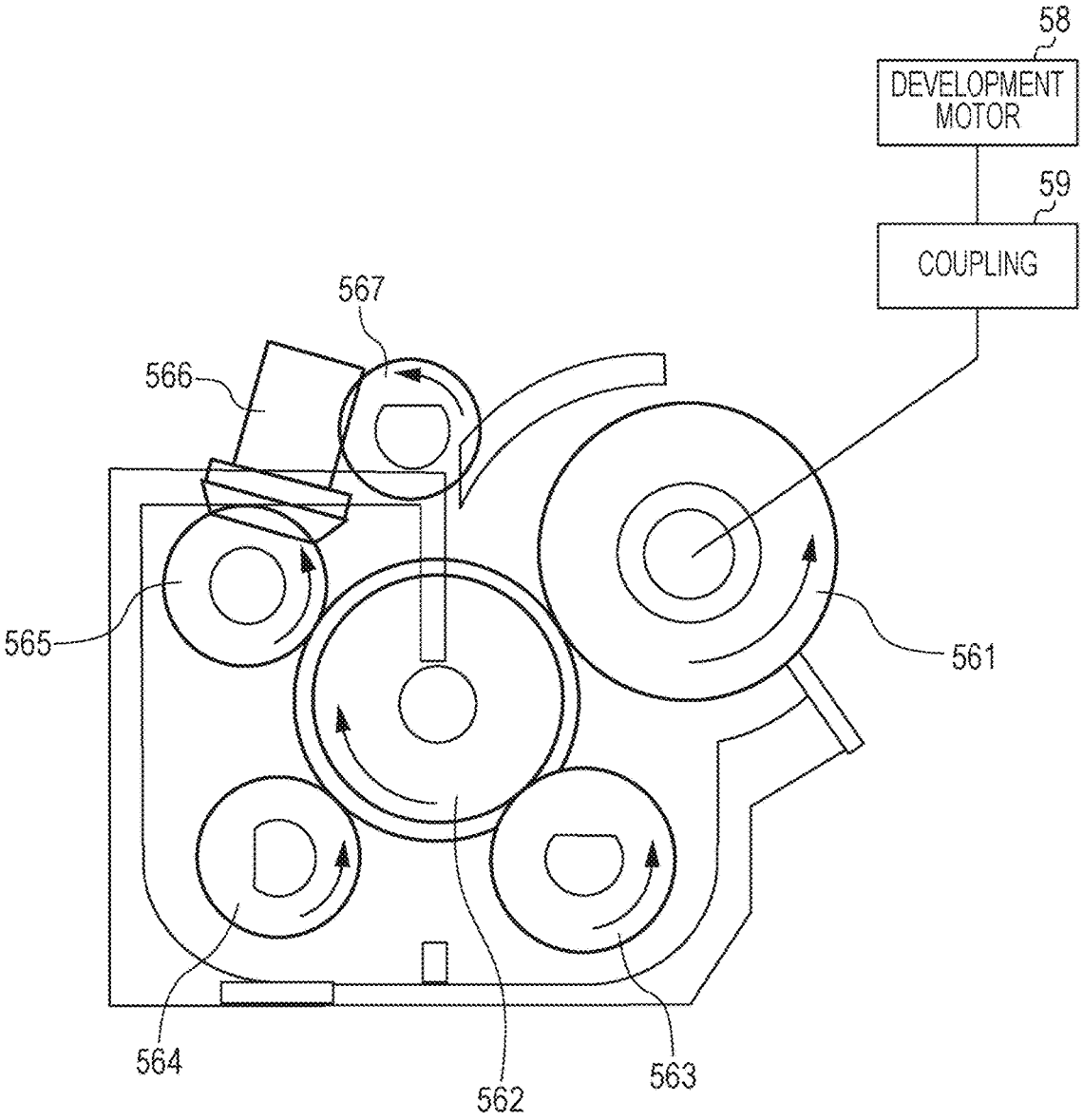
FIG. 7 is a diagram illustrating a gear train included in the developing device according to the first embodiment.

<Outline of Configuration for Winding Up Seals that Seal Initial Developer in Developing Device According to First Embodiment> See FIG. 7

The gear train 56 will now be described with reference to FIG. 7. As illustrated in FIG. 7, the developing sleeve 41 of the developing device 4 is connected to a driving motor 58 via a coupling 59 to and from which the developing sleeve 41 is attachable and detachable in the axial direction. The driving motor 58 is provided in the image-forming-apparatus body 100. The rotation of the developing sleeve 41 is distributed to the first stirring screw 44, the second stirring screw 45, and the winding shaft 55 by the gear train 56 provided opposite the side to which the driving motor 58 is connected. The first stirring screw 44, the second stirring screw 45 and the winding shaft 55 are connected to one another with the gear train 56 in such a manner as to rotate together. When the developing sleeve 41 rotates, a gear 561 provided at an end of the developing sleeve rotates. Then, a gear 562 that is in mesh with the gear 561 and is provided in the center rotates. Furthermore, a gear 563 that is in mesh with the gear 562 causes the first stirring screw 44 to rotate, and a gear 564 causes the second stirring screw 45 to rotate.

Furthermore, the gear 562 and gears 565, 566, and 567 that are in mesh with one another cause the winding shaft 55 to rotate. The gears 566 and 567 are worm gears that significantly reduce the speed of rotation so that the winding shaft 55 can generate a torque required for releasing the sealing sheets 52, 53, and 54. Hence, according to the first embodiment, the developing sleeve 41, the first stirring screw 44, the second stirring screw 45, and the winding shaft 55 are all rotated together by the driving of one driving motor 58.

Thus, the developing sleeve 41 rotates at a rotation speed of 300 rpm, the first stirring screw 44 rotates at a rotation speed of 400 rpm, the second stirring screw 45 rotates at a rotation speed of 450 rpm, and the winding shaft 55 rotates at a rotation speed of 9.5 rpm. Furthermore, in the developing device 4 according to the first embodiment, the developing sleeve 41 has an outside diameter $\phi$ of 20 mm, the first stirring screw 44 and the second stirring screw 45 each have an outside diameter $\phi$ of 16 mm, and the winding shaft 55 has an outside diameter $\phi$ of 4 mm.

Figure 8:
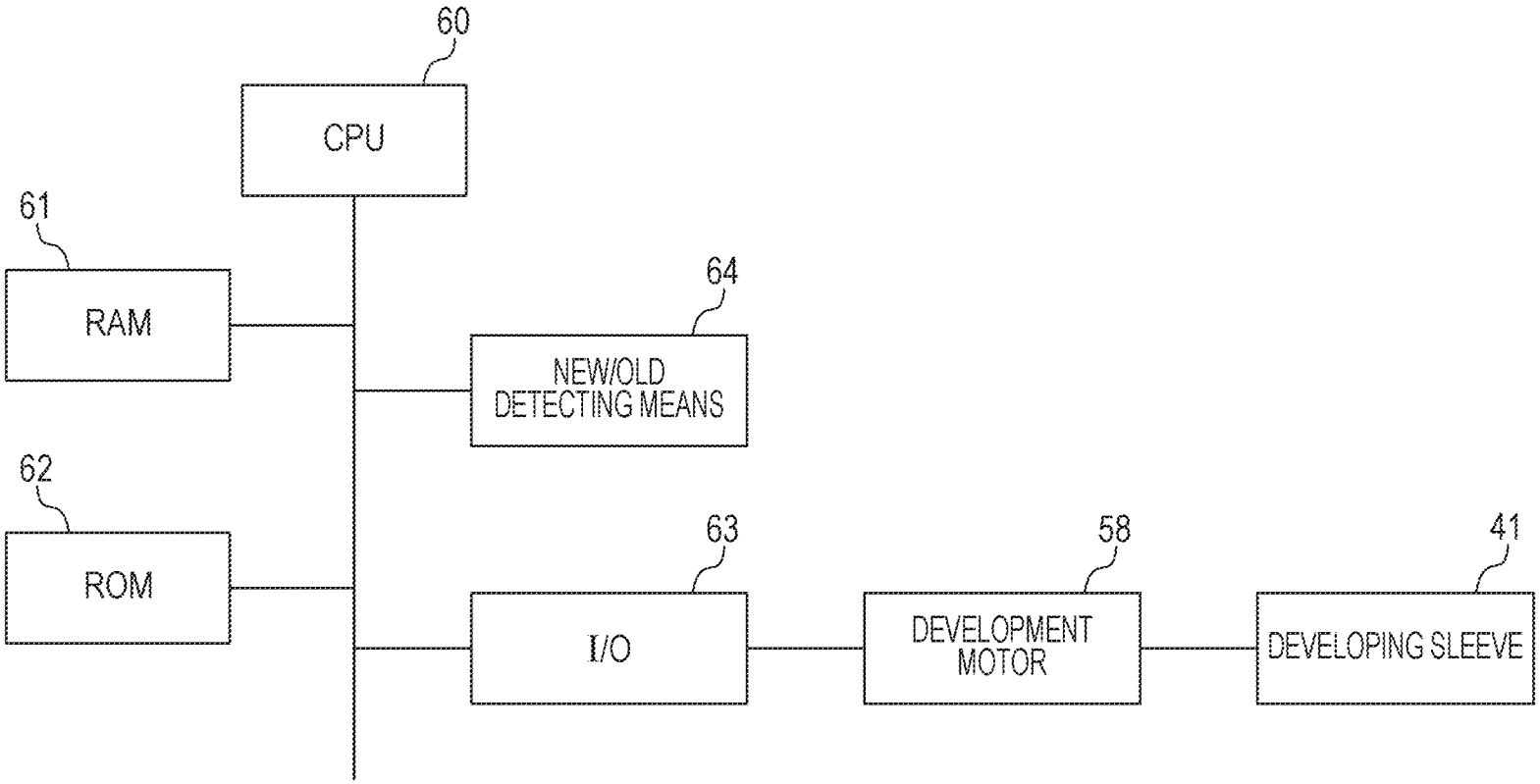
FIG. 8 is a block diagram of a control system according to the first embodiment.
Figure 9:
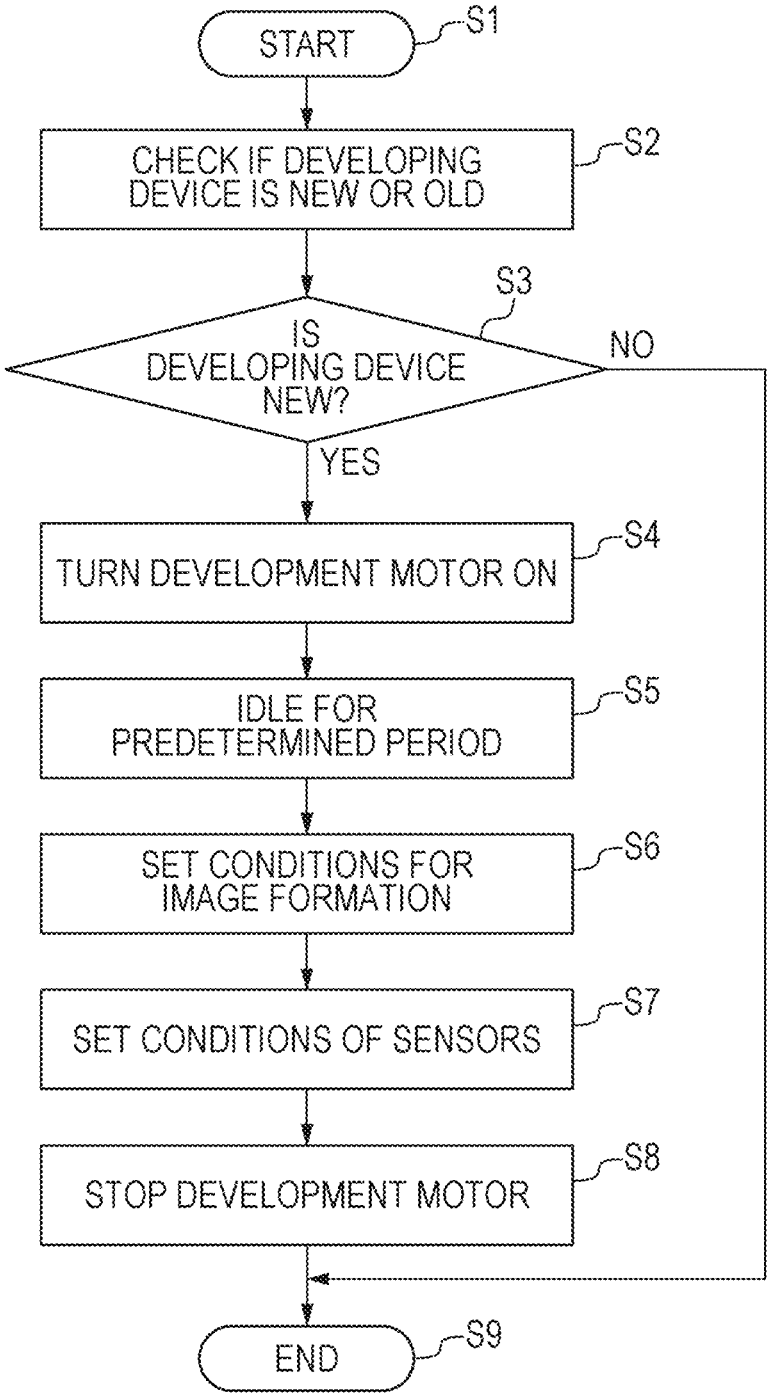
FIG. 9 is a flowchart illustrating a process of controlling the initialization of the developing device according to the first embodiment.

<Controlling Operation at Initialization of Developing Device According to First Embodiment> See FIGS. 8 and 9

Initialization executed when the developing device 4 is attached to the image forming apparatus 100 will now be described with reference to FIGS. 8 and 9. FIG. 8 is a control block diagram according to the first embodiment. FIG. 9 is a diagram illustrating a flowchart.

The image forming apparatus 100 includes a CPU 60. The CPU 60 is connected to a RAM 61 used as a working memory, and to a ROM 62 that stores programs to be executed by the CPU and various data. The CPU 60 is also connected to an I/O 63 that activates various sensors provided to the developing devices for the respective colors, the development motors 58 for the respective colors that drive the respective developing devices, and so forth; and to new/old detecting means 64 that detects whether or not the individual developing devices 4 attached are new.

Normally, if any of the developing devices 4 or drum units of the image forming apparatus 100 are replaced with new ones, each of those developing devices 4 is initialized. The initialization progresses as follows. When the power of the image forming apparatus 100 is turned on (step S1), the new/old detecting means 64 detects whether the current developing devices 4 are new or old (step S2) and determines whether the developing devices 4 are new or used (step S3). The developing devices 4 according to the first embodiment are each provided with a fuse as the new/old detecting means 64. A substrate-side terminal of the fuse is in contact with a contact point provided on the body of the image forming apparatus 100. Here, if the developing device 4 is new, a predetermined current is supplied to the fuse and the fuse is broken. Thus, it is determined that the developing device 4 is new. If the developing device 4 is not new but used, the current does not flow because the fuse has already been broken. Therefore, it is determined that the developing device 4 is used. If it is determined that the developing device 4 is new in step S3, the development motor 58 starts to be driven (step S4) and is idled for a predetermined period of time (step S5). In the first embodiment, the idling period was set to 120 sec. During the idling period, the developing sleeve 41, the first stirring screw 44, second stirring screw 45, and the winding shaft 55 are rotated, and the sealing sheets 52 and 53 and the discharge port sealing sheet 54 are released. Thus, the two-component developer contained in the stirring chamber is allowed to circulate throughout the developing device. Consequently, while the surface level of the developer is evened out, the amount of charge imparted to the toner is increased by stirring.

After the developing device 4 is idled for the predetermined period of time, conditions for image formation are set (step S6). Under predetermined conditions for image formation (conditions regarding the photoconductor drum 1 such as the charging voltage, the development bias voltage, the transfer voltage, a tone-correction table, and so forth), toner test patterns based on different exposure values (for a low density and an intermediate density) are formed on the photoconductor drum 1. Subsequently, conditions for sensors are set (step S7). Then, output values (the optimum charging voltage, the optimum development bias voltage, the optimum transfer voltage, and the optimum tone-correction table) are estimated by a density sensor provided on the intermediate transfer belt 11. When the above conditions are all set, the driving of the development motor 58 is stopped (step S8). Thus, the initialization ends (step S9).

Now, the most characteristic feature of the present invention will be described.

First, regarding the driving-torque load applied to the developing device during 120 sec of idling performed in the initialization of the developing device, results of experiments conducted without the developer will be described in detail. This is considered to be the base of the driving-torque load applied to the developing device. Subsequently, the order of winding of the seals, which is characteristic of the present invention, will be described.

Then, temporal changes in the driving-torque load in a state where the stirring chamber is filled with the developer will be described.

Lastly, how the torque load applied to the developing device increases with changes in the state of the developer in the stirring chamber will be described. Thus, an effect of suppressing the torque that is generated in the first embodiment of the present invention will be described.

<Driving-Torque Load Applied to Developing Device (without Developer)> See FIGS. 10, 11, 12, and 13

As illustrated in FIGS. 4 and 5, the first opening 461 according to the first embodiment has a substantially rectangular shape. The seal 52 is thermally welded (bonded) to the periphery of the first opening 461 with a substantially constant bonding width. Therefore, the total bonded area of the seal 52 in the width direction that is orthogonal to the direction of releasing of the seal 52 varies in the direction of releasing of the seal 52 (the vertical direction). Specifically, the total bonded area is larger in each of parts that are on the upstream side and the downstream side, respectively, in the direction of releasing of the seal with respect to the first opening 461 than in the other parts. Therefore, the driving-torque load increases and driving-torque peaks appear at the start and at the completion of the releasing of the seal 52. Likewise, the second opening 461 and the developer discharge port 50 each have a substantially rectangular shape. Therefore, two peaks appear in the driving-torque load. This will be described more specifically. First, the driving-torque load applied to the developing device during initialization will be described. The driving-torque load is roughly categorized into two kinds. One is a driving torque required for the releasing of the seals 52, 53, and 54. The other is a driving torque required for the conveyance of the developer. The two kinds of torques will be described in detail below.

Figure 10:
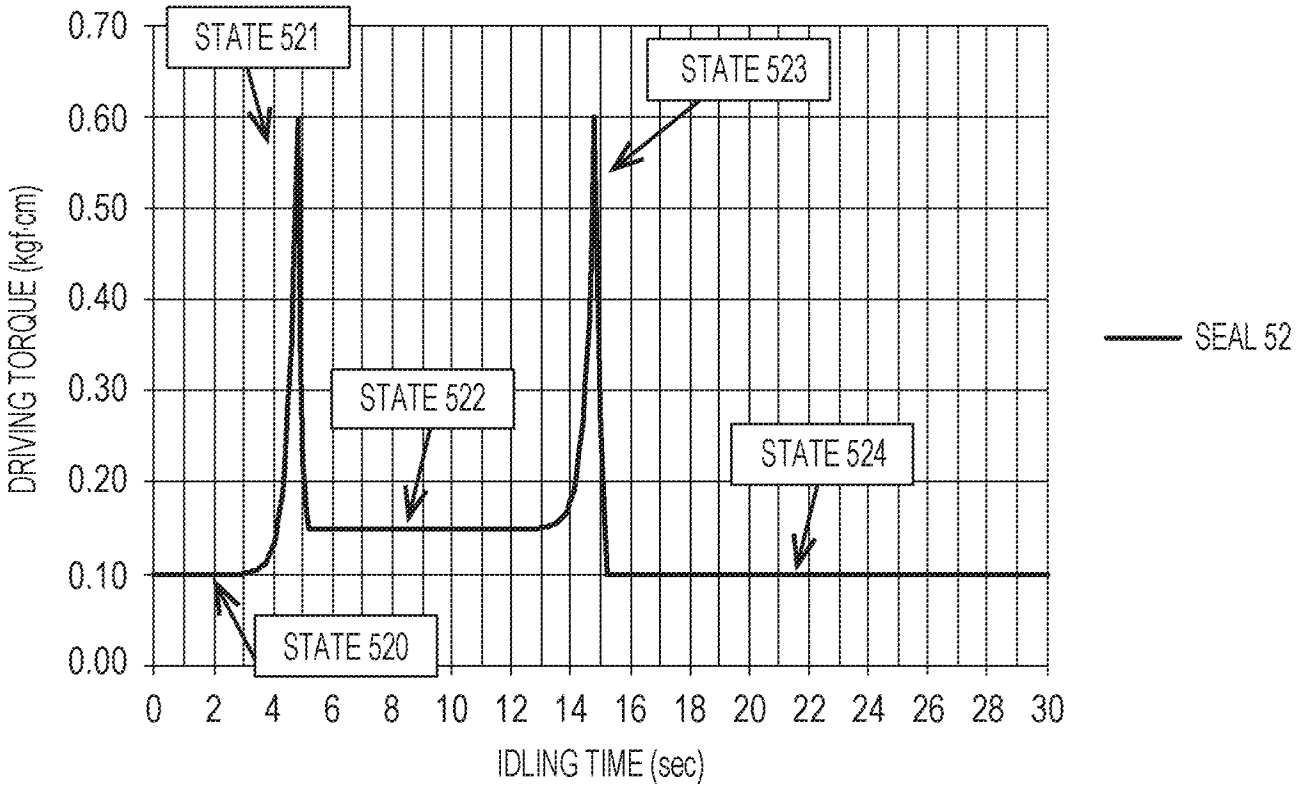
FIG. 10 illustrates temporal changes in the driving-torque load at the time of initialization of the developing device according to the first embodiment (without the developer and with only a seal 52 thermally welded).

First, the torque load generated when the seals 52, 53, and 54 are wound up and thus released will be described. FIG. 10 illustrates temporal changes in the driving-torque load that are observed when initialization is experimentally executed without the developer and with only the seal 52 thermally welded. The horizontal axis represents the time (seconds) elapsed from the start of idling performed in the initialization. The vertical axis represents the driving-torque load applied to the developing device. The changes in the torque observed in this case are roughly categorized into five states.

Figure 11:
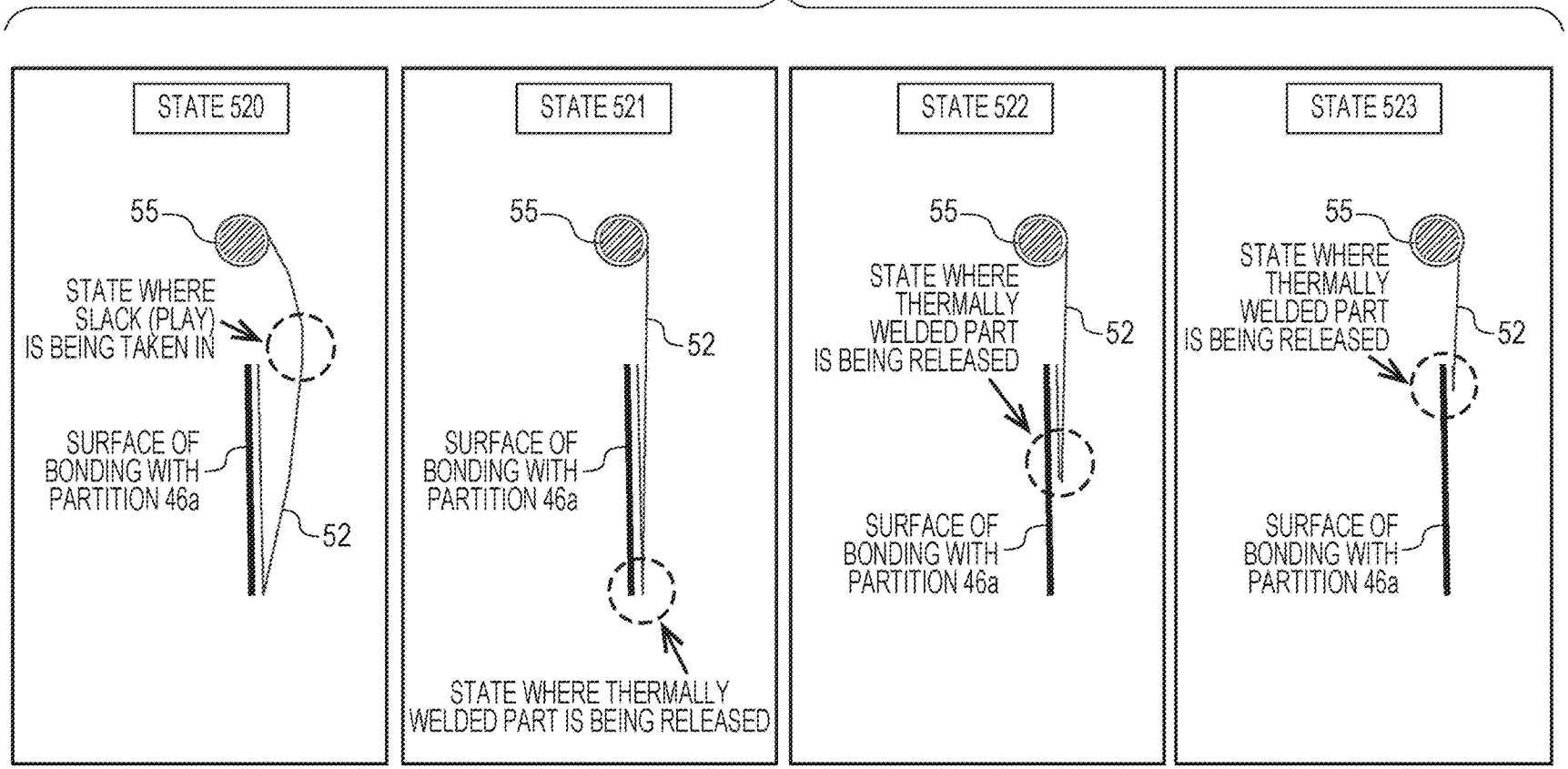
FIG. 11 includes diagrams illustrating changes in the state of releasing of the seal 52 at the time of initialization of the developing device according to the first embodiment.
Figure 12:
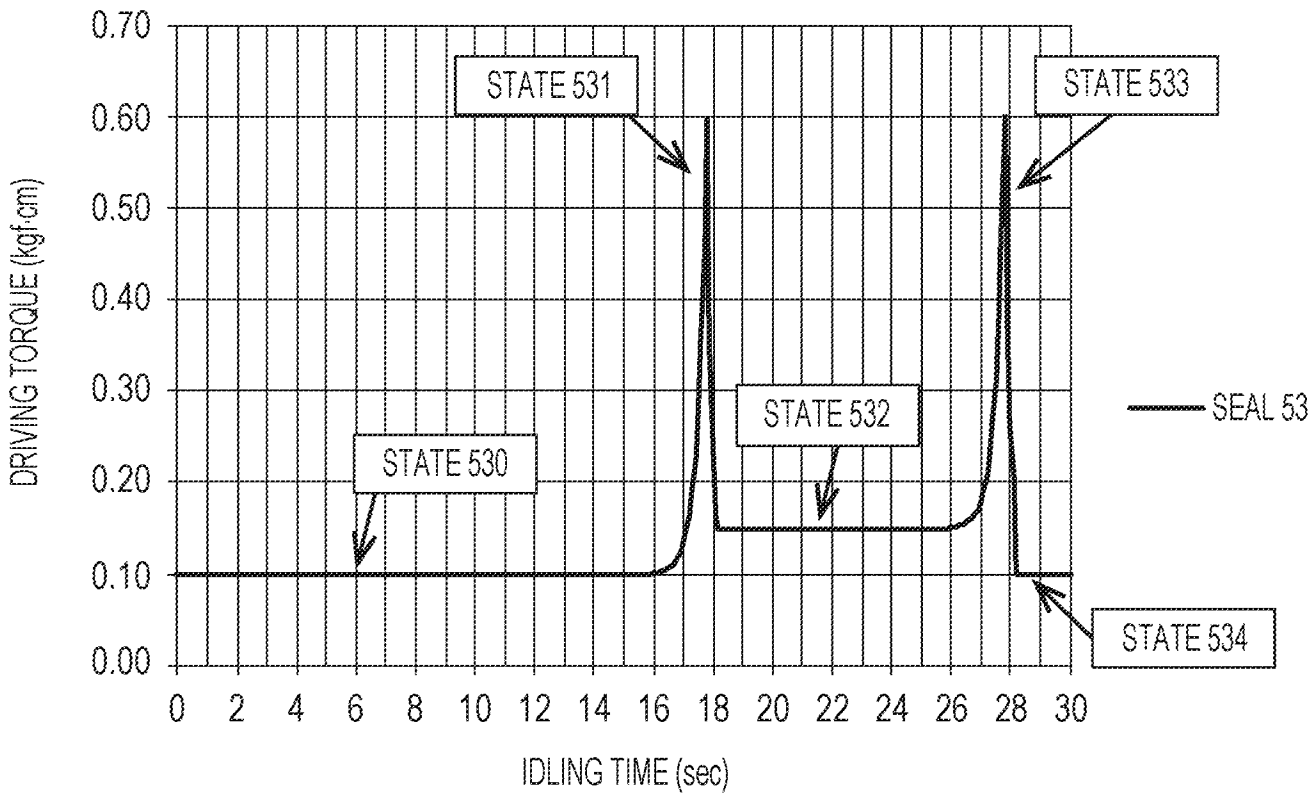
FIG. 12 illustrates temporal changes in the driving-torque load at the time of initialization of the developing device according to the first embodiment (without the developer and with only a seal 53 thermally welded).
Figure 13:
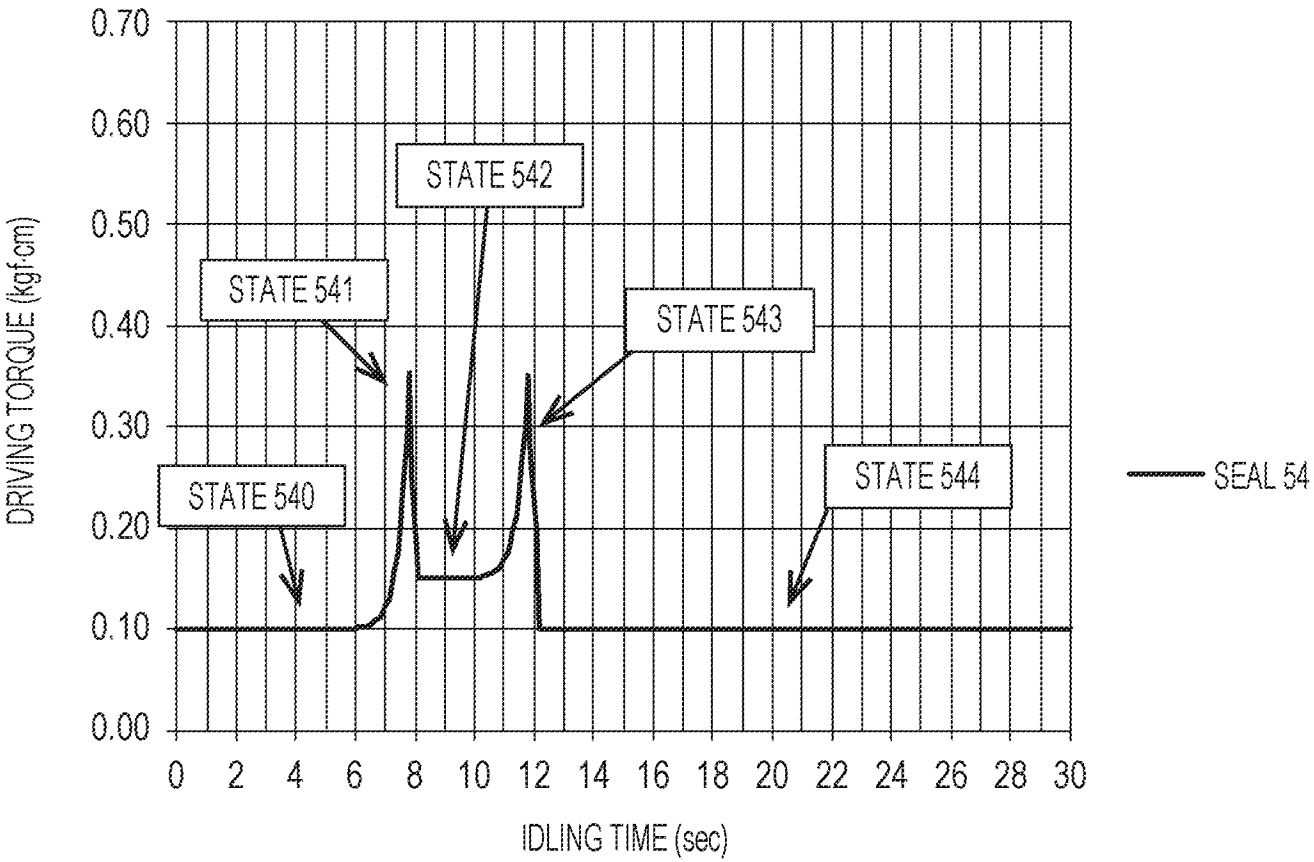
FIG. 13 illustrates temporal changes in the driving-torque load at the time of initialization of the developing device according to the first embodiment (without the developer and with only a seal 54 thermally welded).

First, in a period from 0 to 3 sec, as illustrated in FIG. 11, the winding shaft 55 that has been driven is taking in the slack (play) in the seal 52. In this state (a state 520), the thermally welded part of the seal 52 has substantially no influence upon the driving-torque load, and the developing device is driven with only a torque (=0.1 kgf·cm) required for driving the winding shaft 55, the developing sleeve 41, the first and second stirring screws 44 and 45.

In a subsequent period from 3 to 4.8 sec, as illustrated in FIG. 11, the slack (play) in the seal 52 has been fully taken in by the winding shaft 55, and, among the thermally welded parts between the seal 52 and the first opening 461, a thermally welded part that is on the vertically lower side of the first opening 461 and has a longitudinal width of 30 mm is being released (a state 521). In this state, the driving-torque load increases with the releasing of that thermally welded part and reaches 0.6 kgf·cm.

In a subsequent period from 5 to 13 sec, as illustrated in FIG. 11, the thermally welded parts between the seal 52 and the first opening 461 continue to be released (a state 522). In this state 522, those thermally welded parts that are at two respective ends of the first opening 461 in the direction of the longitudinal width of 30 mm are only released. Therefore, the driving-torque load is smaller, specifically, 0.15 kgf·cm, than that observed in the state 521.

In a subsequent period from 13 to 14.8 sec, as illustrated in FIG. 11, among the thermally welded parts between the first opening 461 and the seal 52, a thermally welded part that is on the vertically upper side of the first opening 461 and has a longitudinal width of 30 mm is being released (a state 523). In this state, the thermally welded part that is released is of substantially the same size as that in the state 521. Therefore, the driving-torque load increases to substantially the same level as in the state 521, that is, the driving-torque load reaches 0.6 kgf·cm.

In the last period from 15 to 120 sec, all of the thermally welded parts between the first opening 461 and the seal 52 have been released, which is the same state as the state 520. The developing device is driven only with the torque (=0.1 kgf·cm) that is required for driving the winding shaft 55, the developing sleeve 41, and the first and second stirring screws 44 and 45 (a state 524).

Thus, the driving-torque load changes with time when initialization is executed without the developer and with only the seal 52 thermally welded. Other experiments that are the same as the above were conducted, in one of which only the seal 53 was thermally welded, and in another of which only the seal 54 was thermally welded. The results are graphed in FIGS. 12 and 13. As with the graph in FIG. 10, the horizontal axis represents the time (seconds) elapsed from the start of idling performed in the initialization, and the vertical axis represents the driving-torque load applied to the developing device. In each of the experiments, the seal was released while changes of states from 530 to 534 or from 540 to 544 were observed, as with the case of the seal 52. As graphed in FIG. 13, the driving-torque load at the releasing of the seal 54 was 0.35 kgf·cm, which is smaller than those observed in the cases of the seals 52 and 53. This is because the longitudinal width of the developer discharge port is 10 mm, and the longitudinal width of the welded area of the seal is shorter than those of the seals 52 and 53.

Figure 14:
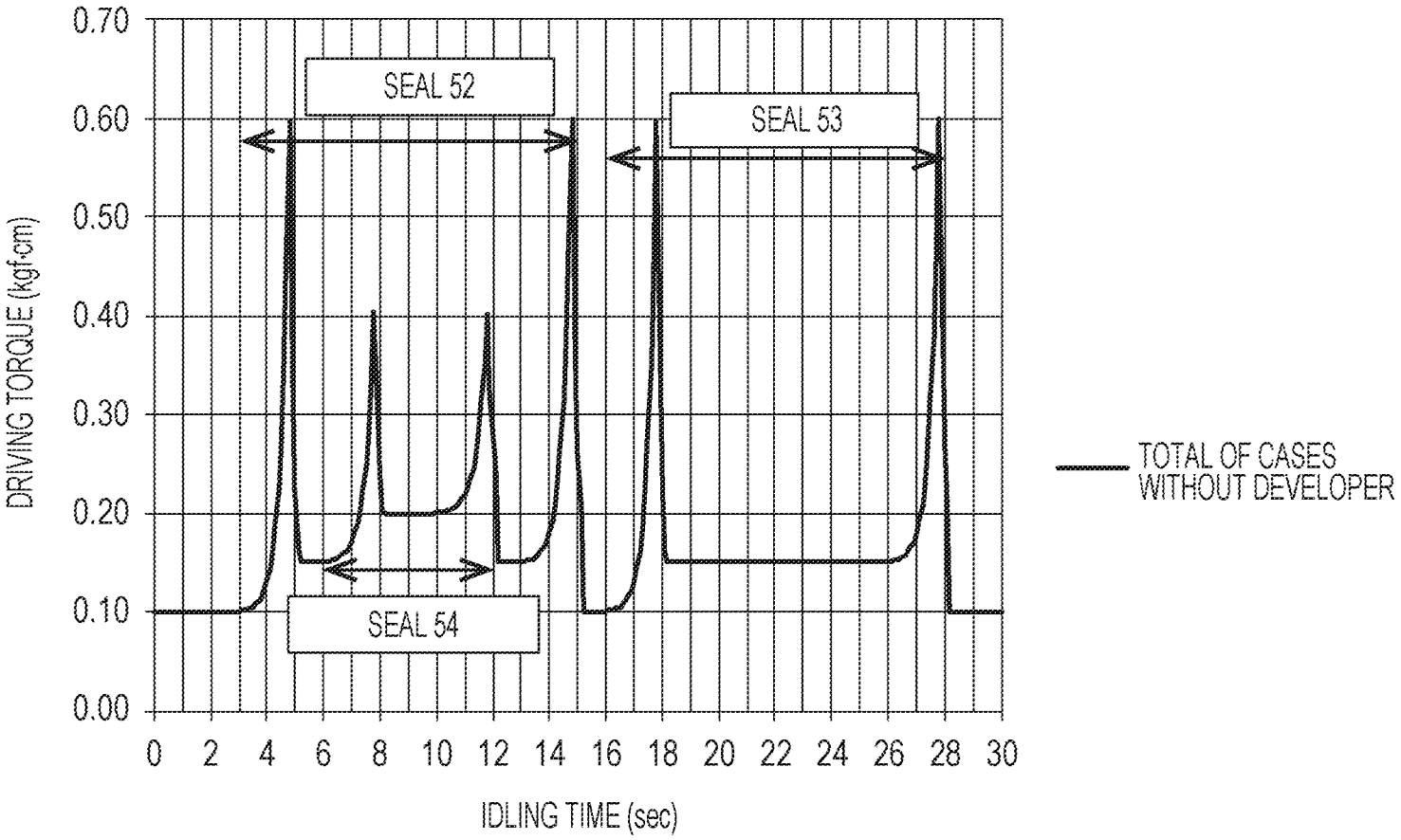
FIG. 14 illustrates temporal changes in the driving-torque load at the time of initialization of the developing device according to the first embodiment (without the developer and with all of the seals 52, 53, and 54 thermally welded).

Lastly, FIG. 14 illustrates temporal changes in the driving-torque load that were observed when initialization (releasing operation) was executed without the developer and with all of the seals 52, 53, and 54 thermally welded. As with the graph in FIG. 10, the horizontal axis represents the time (seconds) elapsed from the start of idling performed in the initialization, and the vertical axis represents the driving-torque load applied to the developing device. The changes in the driving torque in this case are based on the torque (=0.1 kgf·cm) required for driving the winding shaft 55, the developing sleeve 41, and the first and second stirring screws 44 and 45. Furthermore, the changes are graphed as the sum of the driving-torque loads required for releasing the thermally welded parts of the seals 52 to 54, that is, the sum of the graphs illustrated in FIGS. 10, 12, and 13.

<Order of Winding of Seals> See FIG. 14

A configuration according to the first embodiment that defines the order of winding of the seals, which is characteristic of the present invention, will now be described. In the first embodiment, as described above with reference to FIGS. 10 to 14, the thermally welded parts start to be released in the order of the seal 52, the seal 54, and the seal 53.

Specifically, as graphed in FIG. 14, the seal 52 starts to be released at the elapse of three seconds from the start of idling in the initialization of the developing device, and the seal 54 starts to be released at the elapse of six seconds. Then, the releasing of the seal 54 is completed at the elapse of twelve seconds, and the releasing of the seal 52 is completed at the elapse of fifteen seconds. Furthermore, the seal 53 starts to be released at the elapse of sixteen seconds, and the releasing of the seal 53 is completed at the elapse of twenty-eight seconds. That is, the positions of the respective seals at each of which the total bonded area in the width direction orthogonal to the direction of releasing is largest start to be released at different timings that are varied in such a manner as to stagger with respect to one another. Thus, the increase in the total driving-torque load is suppressed.

Furthermore, regarding the positions of the bonded parts of the seal 52 and the seal 53, the seals are each thermally welded in areas each having a width of about 4 mm and that are on the lower side and on the upper side, respectively, of a corresponding one of the first opening 461 and the second opening 462. The first opening 461 and the second opening 462 each have a height of 16 mm. These thermally welded parts are each wound up by the winding shaft 55 of ϕ4 that is rotated at 9.5 rpm. In this case, it takes about twelve seconds from the start to the completion of the releasing. The seal 54 provided over the developer discharge port having an opening width in the winding direction of 4 mm is thermally welded in areas each having a width of about 4 mm and that are on the upstream side and on the downstream side, respectively, of the developer discharge port in the direction of winding. These thermally welded parts are each wound up by the winding shaft 55 of ϕ4 that is rotated at 9.5 rpm. In this case, it takes about six seconds from the start to the completion of the releasing.

Figure 18:
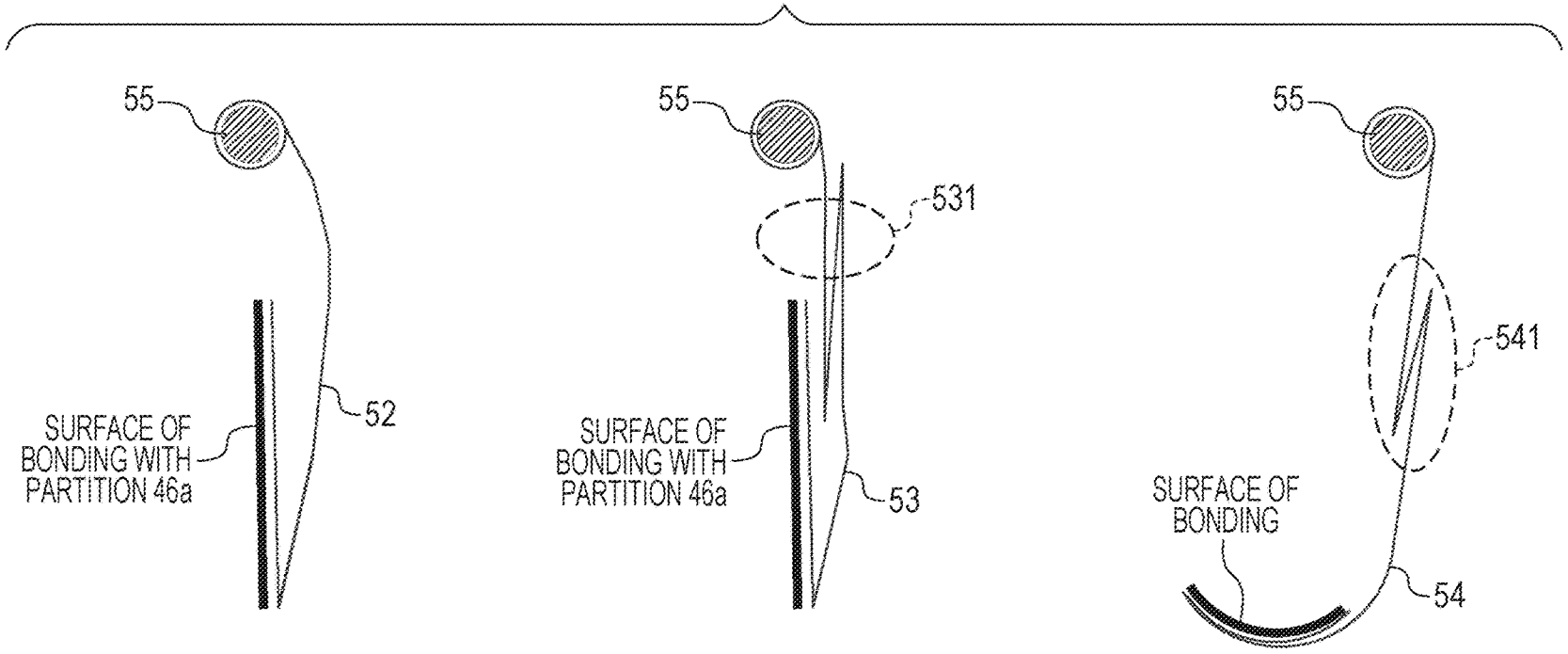
FIG. 18 includes diagrams illustrating play slacks in the respective seals included in the developing device according to the first embodiment.
Figure 19:
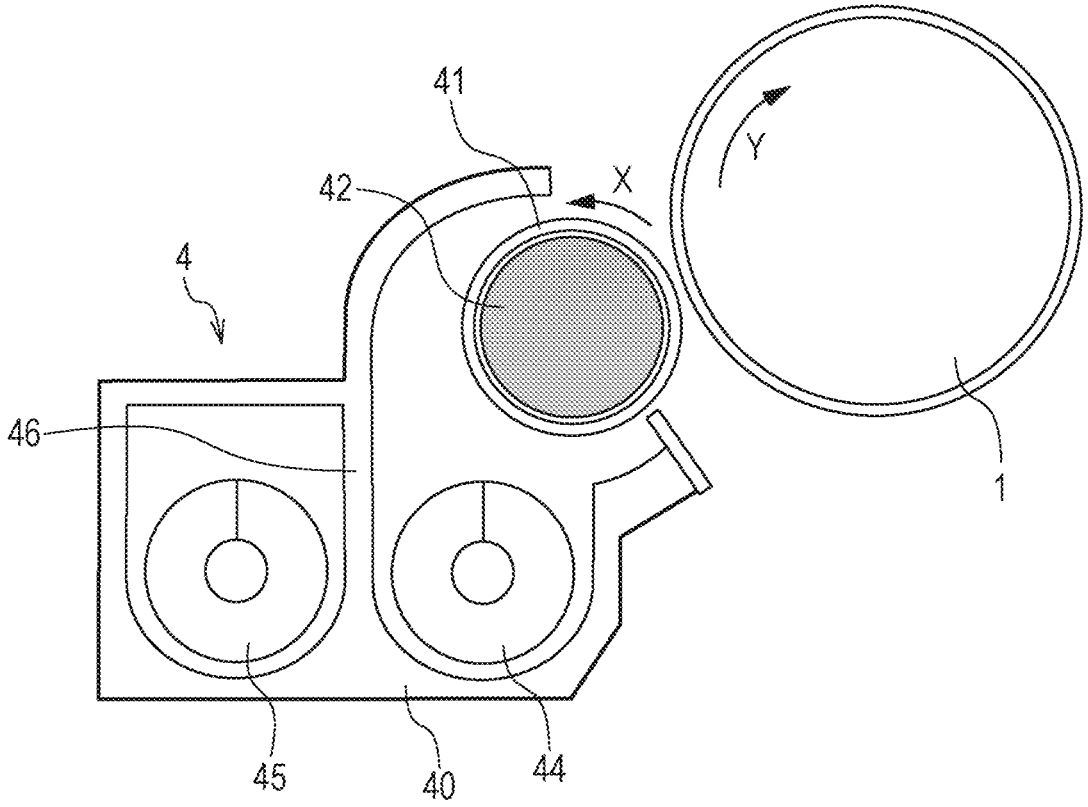
FIG. 19 is a schematic sectional view of a related-art developing device that employs a two-component developing method.

In the first embodiment, as graphed in FIG. 14, to stagger the timings of rapid increases in the driving torque generated when the sealing sheets 52 to 54 are released, the order of releasing is defined carefully. The present invention is characteristic or important in that the thermally welded parts of the seal 52, the seal 54, and the seal 53 start to be released in that order as described above. The effect produced by this characteristic feature will now be described in detail. In the first embodiment, specifically, the seal 54 includes a play slack 541 as illustrated in FIG. 18. Thus, the seal 54 starts to be wound up later than the seal 52. Furthermore, the seal 53 includes a play slack 531. Thus, the seal 53 starts to be wound up later than the seal 54. Specifically, the play slack in the seal 54 is 6 mm longer and the play slack in the seal 53 is 26 mm longer than the play slack in the seal 52.

The method of controlling the order of winding of the seals is not limited to providing such play slacks and may be any other method. For example, the diameter of the winding shaft 55 may be varied with the positions to which the seals are pasted. Such a method also produces the advantageous effect of the present invention without hindrance.

While the first embodiment concerns an exemplary case where the first opening 461, the second opening 462, and the developer discharge port 50 each have a substantially rectangular shape, the present invention is not limited to such a case. The timings of rapid increases in the driving torque at the time of releasing only need to be staggered with respect to one another, considering the shapes of the seals.

<Temporal Changes in Driving-Torque Load with Stirring Chamber Filled with Developer>

Now, temporal changes in the driving-torque load according to the first embodiment that are observed during initialization performed in a state where the stirring chamber is filled with the developer will be described in detail.

Figure 15:
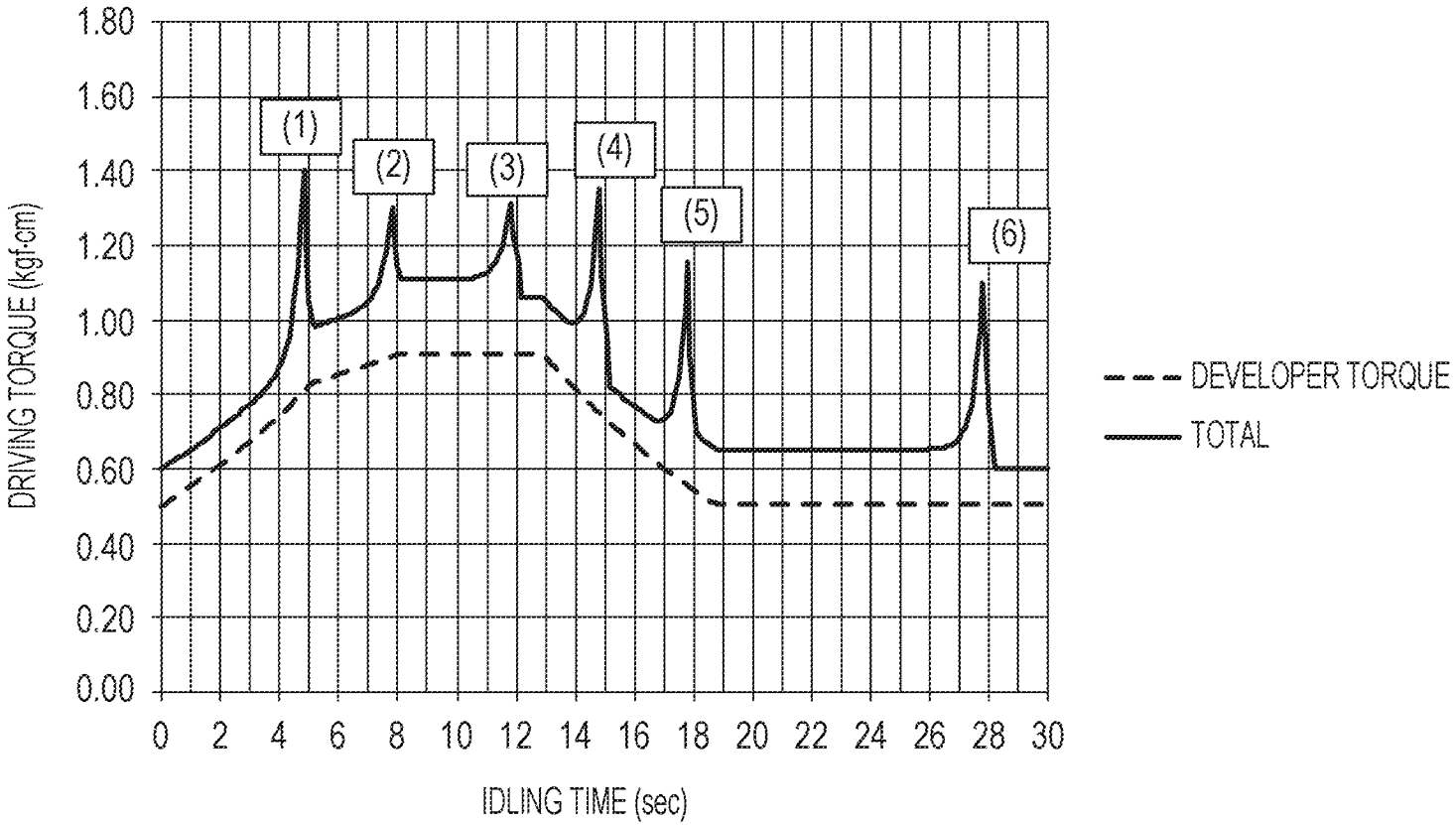
FIG. 15 illustrates temporal changes in the driving-torque load at the time of initialization of the developing device according to the first embodiment (with the developer in the stirring chamber distributed substantially evenly in the longitudinal direction).

First, a case where the developer in the stirring chamber is distributed substantially evenly in the longitudinal direction will be discussed. FIG. 15 illustrates temporal changes in the torque with respect to idling time in this case. The horizontal axis represents the time (seconds) elapsed from the start of idling performed in the initialization. The vertical axis represents the driving-torque load applied to the developing device. The solid line in the graph represents the total driving-torque load. The dotted line in the graph represents a component of the driving-torque load that is attributed to the developer. Now, temporal changes in the torque will be described in detail.

First, before the seal 52 starts to be released, the developer that is conveyed by the stirring screw cannot be discharged anywhere from the stirring chamber. Therefore, the developer is pushed toward the first opening 461 and toward the developer discharge port 50. Such a movement of the developer increases the driving-torque load, and the driving-torque load becomes largest (peak (1)) when the seal is released. As the first opening 461 is gradually opened, the rate of increase in the torque that is attributed to the developer is reduced a little. However, the torque attributed to the pushing of the developer that is conveyed by the stirring screw continues to increase. When the seal 54 starts to be released (at peak (2)) and the discharge port 50 starts to be opened, the increase in the torque attributed to the pushing of the developer subsides at last. Then, the seal 54 continues to be released, and the discharge port 50 is completely opened (at peak (3)). Substantially at this point of time, the torque load attributed to the developer starts to be reduced. Subsequently, when the seal 52 is released and the first opening 461 is completely opened (at peak (4)), the torque attributed to the developer is further reduced. Then, the torque load attributed to the developer is stabilized at about 0.5 kgf·cm. In this state, the seal 53 starts to be released (at peak (5)) and is then completely released (at peak (6)).

As described above, in the first embodiment of the present invention, the total torque applied to the developing device in the above case can be suppressed to about 1.4 kgf·cm at maximum.

Figure 16:
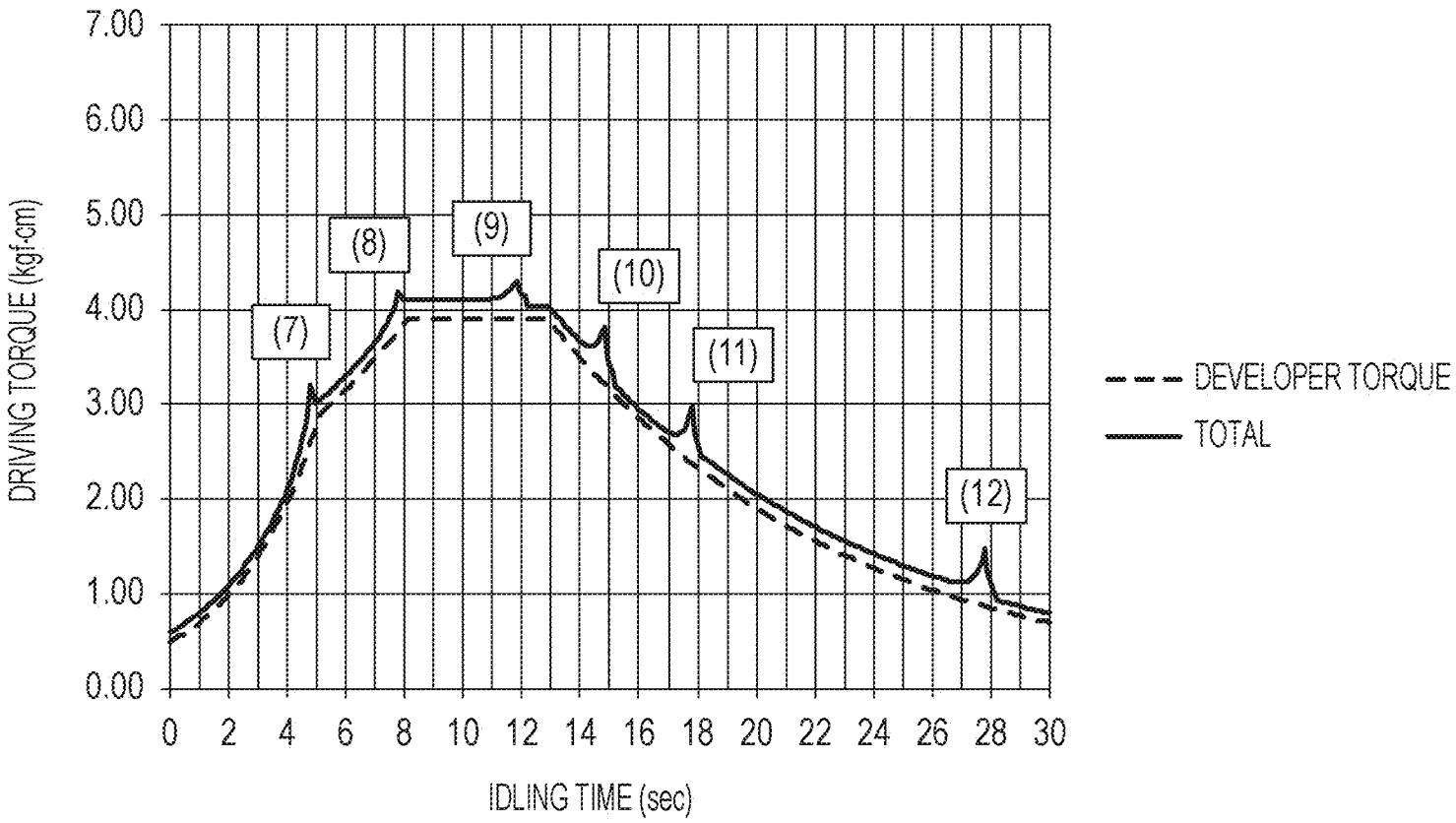
FIG. 16 illustrates temporal changes in the driving-torque load at the time of initialization of the developing device according to the first embodiment (with the developer distributed more on the side of a first opening 461).

Now, another case will be discussed where the developer in the stirring chamber is distributed more on the side of the first opening 461 in the longitudinal direction. Such a situation is triggered by, for example, transportation or the like. FIG. 16 illustrates temporal changes in the torque with respect to idling time in that case. The horizontal axis represents the time (seconds) elapsed from the start of idling performed in the initialization. The vertical axis represents the driving-torque load applied to the developing device. The solid line in the graph represents the total driving-torque load. The dotted line in the graph represents a component of the driving-torque load that is attributed to the developer. Now, temporal changes in the torque will be described in detail.

First, before the seal 52 starts to be released, the developer that is conveyed by the stirring screw cannot be discharged anywhere from the stirring chamber. Therefore, the developer is pushed toward the first opening 461 and toward the discharge port 50. Such a movement of the developer increases the driving-torque load, and a peak of the driving-torque load (peak (7)) appears when the seal is released. The driving-torque load at this point of time was very large, about 3.2 kgf·cm, because the developer was initially distributed more on the side of the first opening 461. Subsequently, as the first opening 461 is gradually opened, the rate of increase in the torque that is attributed to the developer is reduced a little. However, the torque attributed to the pushing of the developer that is conveyed by the stirring screw continues to increase. When the seal 54 starts to be released (at peak (8)) and the discharge port 50 starts to be opened, the increase in the torque attributed to the pushing of the developer subsides at last. Then, the seal 54 continues to be released, and the discharge port 50 is completely opened (at peak (9)). Substantially at the same point of time, the torque load attributed to the developer starts to be reduced. Subsequently, when the seal 52 is released and the first opening 461 is completely opened (at peak (10)), the torque attributed to the developer is further reduced. Then, the torque load attributed to the developer continues to be reduced and is saturated at about 0.5 kgf·cm at the elapse of about thirty-five seconds. During this process, the seal 53 starts to be released (at peak (11)) and is then completely released (at peak (12)).

As described above, if the developer in the stirring chamber is distributed more on the side of the first opening 461 as a result of transportation or the like, the driving-torque load included in the total torque applied to the developing device tends to increase because the load attributed to the developer tends to be large. However, even in such a case, according to the first embodiment of the present invention, the total torque applied to the developing device can be suppressed to about 4.3 kgf·cm at maximum.

Figure 17:
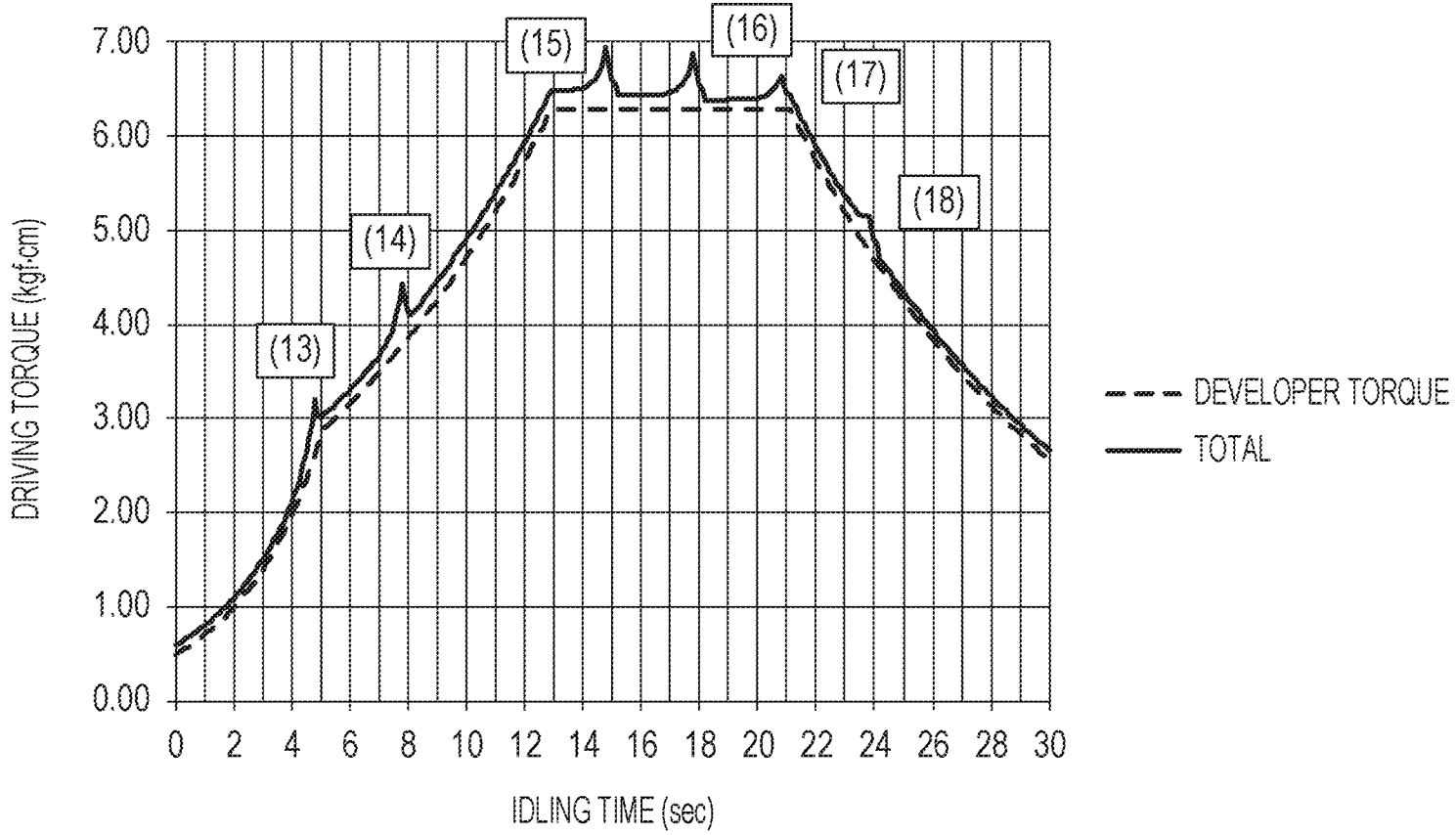
FIG. 17 illustrates temporal changes in the driving-torque load at the time of initialization in a comparative embodiment with respect to the first embodiment (with the developer distributed more on the side of the first opening 461).

Lastly, a comparative embodiment in which the seals start to be released in the order of the seal 52, the seal 53, and the seal 54 will be described. In the comparative embodiment also, the case where the developer in the stirring chamber is distributed more on the side of the first opening 461 in the longitudinal direction will be discussed. FIG. 17 illustrates temporal changes in the torque with respect to idling time in that case. The horizontal axis represents the time (seconds) elapsed from the start of idling performed in the initialization. The vertical axis represents the driving-torque load applied to the developing device. The solid line in the graph represents the total driving-torque load. The dotted line in the graph represents a component of the driving-torque load that is attributed to the developer. The following example concerns a developing device that does not have the characteristic feature of the present invention, and the seals are wound up in the order of the seal 52, the seal 53, and the seal 54. Now, temporal changes in the torque will be described in detail.

First, before the seal 52 starts to be released, the developer that is conveyed by the stirring screw cannot be discharged anywhere from the stirring chamber. Therefore, the developer is pushed toward the first opening 461 and toward the discharge port 50. Such a movement of the developer increases the driving-torque load, and a peak of the driving-torque load (peak (13)) appears when the seal is released. Subsequently, as the first opening 461 is gradually opened, the rate of increase in the torque that is attributed to the developer is reduced a little. However, the torque attributed to the pushing of the developer that is conveyed by the stirring screw continues to increase significantly. Even after the seal 53 starts to be released (at peak (14)), the driving-torque load continues to increase. Then, when the first opening 461 is about to be completely opened (immediately before peak (15)), the increase in the driving-torque load attributed to the developer subsides at last. Then, the releasing of the seal 53 is completed (at peak (16)), the seal 54 starts to be released (peak (17)), and the discharge port 50 starts to be opened. Hence, the driving-torque load attributed to the developer starts to be reduced at last. Then, the releasing of the seal 54 is completed (peak (18)). Accordingly, the torque attributed to the developer and the total torque applied to the developing device continue to be reduced and are saturated at about 0.5 kgf·cm at the elapse of about forty-five seconds.

As described above, in the developing device that does not have the characteristic feature of the present invention, when the developer in the stirring chamber is distributed more on the side of the first opening 461 as a result of transportation or the like, the total torque applied to the developing device increases significantly, occasionally reaching about 7.0 kgf·cm at maximum. Moreover, when such an experiment was conducted for a plurality of times, the driving-torque load broke the second stirring screw 45 in some cases.

Considering the above results, in the configuration according to the first embodiment of the present invention, the driving-torque load occurring at the time of initialization of the developing device can be reduced effectively. The feature that is most characteristic of the present invention is winding up the seals in the order of the seal 52, the seal 54, and the seal 53 and thus providing a path that allows the developer conveyed in the stirring chamber to be discharged, whereby the increase in the torque attributed to the pushing of the developer that is conveyed is suppressed.

According to the present invention, in the developing device including the sealing member that seals an initial portion of the developer in the developing device, the load torque generated at the releasing of the sealing member can be made small even if the distribution of the developer in the development container at the releasing of the sealing member is uneven.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2015/051629, filed Jan. 22, 2015, which is hereby incorporated by reference herein in its entirety.

The invention claimed is:

1. A developing device comprising:

a first chamber that contains developer in an initial state;

a second chamber that provides, communication with the first chamber, a path of circulation of the developer;

a partition that separates the first chamber and the second chamber from each other;

a first conveying member, provided in the first chamber, for conveying the developer in the first chamber;

a second conveying member, provided in the second chamber, for conveying the developer in the second chamber;

a first communication port provided on a downstream side in a direction of conveyance in the first chamber and that delivers the developer from the first chamber to the second chamber;

a second communication port provided on an upstream side in the direction of conveyance in the first chamber and that delivers the developer from the second chamber to the first chamber;

a first sealing portion bonded to a periphery of the first communication port and that releasably seals the first communication port;

a second sealing portion bonded to a periphery of the second communication port and that releasably seals the second communication port;

a supply port from which the developer is supplied, the developer being a mixture of a magnetic carrier and a nonmagnetic toner;

a discharge port from which of the developer is dischargeable outside the developing device;

a third sealing portion bonded to a periphery of the discharge port and that releasably seals the discharge port; and a winding shaft to which the first sealing portion, the second sealing portion, and the third sealing portion are attached and that is capable of winding up the sealing portions when receiving a driving force, wherein when the winding shaft releases the first sealing portion, the second sealing portion and the third sealing portion, release of the third sealing portion starts after starting to release the first sealing portion.

2. The developing device according to claim 1, wherein the first communication port, the second communication port, and the discharge port each have a substantially rectangular shape.

3. The developing device according to claim 1, wherein the releasing of the second sealing portion is started after the releasing of the first sealing portion is started.

4. The developing device according to claim 1, further comprising a developer bearing member that bears the developer and develops a latent image formed on an image bearing member, wherein the second chamber is a chamber from which the developer is supplied to the developer bearing member.

5. The developing device according to claim 1, wherein the first conveying member includes a first screw portion having a helical shape and that conveys the developer in the first chamber toward a downstream side in a direction of conveyance in the first chamber;

a second screw portion provided on the downstream side with respect to the first screw portion in the direction of conveyance by the first screw portion and whose direction of helix is opposite to that of the first screw portion; and a third screw portion provided on the downstream side with respect to the second screw portion in the direction of conveyance by the first screw portion and whose direction of helix is the same as that of the first screw portion, and wherein the discharge port discharges the developer that is conveyed by the third screw portion.

6. The developing device according to claim 1, further comprising a shutter that is capable of opening and closing the discharge port.

7. The developing device according to claim 1, wherein a timing to start releasing one sealing portion among the first sealing portion, the second sealing portion and the third sealing portion doesn't overlap with a timing of releasing a portion having maximum bonding width of another sealing portion with respect to a width direction that is orthogonal to a direction of releasing of the another sealing portion, arranged downstream to an aperture sealed by the another sealing portion in a sealing direction of the another sealing portion.

8. The developing device according to claim 1, wherein the releasing of the second sealing portion is started after the releasing of the first sealing portion and the third sealing portion are started.

9. The developing device according to claim 1, wherein the opening of the second communication port is started after the opening of the first communication port and the opening of the discharge port are started.

10. A developing device comprising:

a first chamber that contains developer in an initial state;

a second chamber that provides, in communication with the first chamber, a path of circulation of the developer;

a partition that separates the first chamber and the second chamber from each other;

a first conveying member, provided in the first chamber, for conveying the developer in the first chamber;

a second conveying member, provided in the second chamber, for conveying the developer in the second chamber;

a first communication port provided on a downstream side in a direction of conveyance in the first chamber and that delivers the developer from the first chamber to the second chamber;

a second communication port provided on an upstream side in the direction of conveyance in the first chamber and that delivers the developer from the second chamber to the first chamber;

a first sealing portion bonded to a periphery of the first communication port and that removably seals the first communication port;

a second sealing portion bonded to a periphery of the second communication port and that removably seals the second communication port;

a supply port from which the developer is supplied, the developer being a mixture of a magnetic carrier and a nonmagnetic toner;

a discharge port from which the developer is dischargeable outside the developing device;

a third sealing portion bonded to a periphery of the discharge port and that removably seals the discharge port; and a winding shaft to which the first sealing portion, the second sealing portion, and the third sealing portion are attached and that is capable of winding up the sealing portions when receiving a driving force, wherein when the winding shaft removes the first sealing portion, the second sealing portion and the third sealing portion, opening of the discharge port starts after starting to open the first communication port.

11. The developing device according to claim 10, wherein the first communication port, the second communication port, and the discharge port each have a substantially rectangular shape.

12. The developing device according to claim 10, wherein the opening of the second communication port is started after the opening of the first communication port is started.

13. The developing device according to claim 10, further comprising a developer bearing member that bears the developer and develops a latent image formed on an image bearing member, wherein the second chamber is a chamber from which the developer is supplied to the developer bearing member.

14. The developing device according to claim 10, wherein the first conveying member includes a first screw portion having a helical shape and that conveys the developer in the first chamber toward a downstream side in a direction of conveyance in the first chamber;

a second screw portion provided on the downstream side with respect to the first screw portion in the direction of conveyance by the first screw portion and whose direction of helix is opposite to that of the first screw portion; and a third screw portion provided on the downstream side with respect to the second screw portion in the direction of conveyance by the first screw portion and whose direction of helix is the same as that of the first screw portion, and wherein the discharge port discharges the developer that is conveyed by the third screw portion.

15. The developing device according to claim 10, further comprising a shutter that is capable of opening and closing the discharge port.

16. The developing device according to claim 10, wherein a timing to start removing one sealing portion among the first sealing portion, the second sealing portion and the third sealing portion doesn't overlap with a timing of removing a portion having maximum bonding width of another sealing portion with respect to a width direction that is orthogonal to a direction of removing of the another sealing portion, arranged downstream to an aperture sealed by the another sealing portion in a sealing direction of the another sealing portion.

17. A developing device comprising:

a first chamber that contains developer in an initial state;

a second chamber that provides, in communication with the first chamber, a path of circulation of the developer;

a partition that separates the first chamber and the second chamber from each other;

a first conveying member, provided in the first chamber, for conveying the developer in the first chamber;

a second conveying member, provided in the second chamber, for conveying the developer in the second chamber;

a first communication port provided on a downstream side in a direction of conveyance in the first chamber and that delivers the developer from the first chamber to the second chamber;

a second communication port provided on an upstream side in the direction of conveyance in the first chamber and that delivers the developer from the second chamber to the first chamber;

a first sealing portion bonded to a periphery of the first communication port and that removably seals the first communication port;

a second sealing portion bonded to a periphery of the second communication port and that removably seals the second communication port;

a supply port from which the developer is supplied, the developer being a mixture of a magnetic carrier and a nonmagnetic toner;

a discharge port from which the developer is dischargeable outside the developing device;

a third sealing portion bonded to a periphery of the discharge port and that removably seals the discharge port; and a winding shaft to which the first sealing portion, the second sealing portion, and the third sealing portion are attached and that winds up the first sealing portion, the second sealing portion, and the third sealing portion when receiving a driving force.

18. The developing device according to claim 17, wherein the first communication port, the second communication port, and the discharge port each have a substantially rectangular shape.

19. The developing device according to claim 17, further comprising a developer bearing member that bears the developer and develops a latent image formed on an image bearing member, wherein the second chamber is a chamber from which the developer is supplied to the developer bearing member.

20. The developing device according to claim 17, wherein the first conveying member includes a first screw portion having a helical shape and that conveys the developer in the first chamber toward a downstream side in a direction of conveyance in the first chamber;

a second screw portion provided on the downstream side with respect to the first screw portion in the direction of conveyance by the first screw portion and whose direction of helix is opposite to that of the first screw portion; and a third screw portion provided on the downstream side with respect to the second screw portion in the direction of conveyance by the first screw portion and whose direction of helix is the same as that of the first screw portion, and wherein the discharge port discharges the developer that is conveyed by the third screw portion.

21. The developing device according to claim 17, further comprising a shutter that is capable of opening and closing the discharge port.

22. The developing device according to claim 17, the first sealing portion, the second sealing portion, and the third sealing portion are arranged alongside in the direction of conveyance in the first chamber.

23. The developing device according to claim 17, the first sealing portion, the second sealing portion, and the third sealing portion are removed in a perpendicular direction to the direction of conveyance in the first chamber.

24. The developing device according to claim 17, winding shaft is arranged at a position upper than a position of first communication port, a position of the second communication port, and a position of the discharge port.

25. The developing device according to claim 17, the driving force drive the first conveying member.

* * * * *